US005747213A

United States Patent [19]

Okado et al.

[11] Patent Number: 5,747,213

[45] Date of Patent: May 5, 1998

[54] IMAGE FORMING METHOD AND HEAT FIXING METHOD USING A TONER INCLUDING A WAX

[75] Inventors: Kenji Okado; Ryuichiro Maeyama; Kouji Inaba, all of Yokohama, Japan

[73] Assignee: Canon Kabushiki Kaisha, Tokyo, Japan

[21] Appl. No.: 654,691

[22] Filed: May 29, 1996

[30] Foreign Application Priority Data

May 31, 1995 [JP] Japan ..... 7-156771
Jan. 26, 1996 [JP] Japan ..... 8-031223

[51] Int. Cl.[6] ..... G03G 13/20

[52] U.S. Cl. ..... 430/124; 430/110; 430/111

[58] Field of Search ..... 430/124, 110, 430/111

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,917,982 | 4/1990 | Tomono et al. | 430/99 |
| 4,921,771 | 5/1990 | Tomono et al. | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,391,450 | 2/1995 | Nagatsuka et al. | 430/99 |
| 5,510,222 | 4/1996 | Inaba et al. | 430/109 |
| 5,529,873 | 6/1996 | Chiba et al. | 430/109 |

FOREIGN PATENT DOCUMENTS

| | | |
|---|---|---|
| 470479 | 2/1992 | European Pat. Off. . |
| 531990 | 3/1993 | European Pat. Off. . |
| 0587540 | 3/1994 | European Pat. Off. . |
| 621511 | 10/1994 | European Pat. Off. . |
| 0 627 669 A1 | 12/1994 | European Pat. Off. . |
| 686885 | 12/1995 | European Pat. Off. . |
| 36-10231 | 7/1961 | Japan . |
| 42-23910 | 11/1967 | Japan . |
| 43-24748 | 10/1968 | Japan . |
| 50-81342 | 7/1975 | Japan . |
| 52-3304 | 1/1977 | Japan . |
| 52-3305 | 1/1977 | Japan . |
| 56-13945 | 4/1981 | Japan . |
| 57-52574 | 11/1982 | Japan . |
| 59-53856 | 3/1984 | Japan . |
| 59-61842 | 4/1984 | Japan . |
| 60-217366 | 10/1985 | Japan . |
| 60-252360 | 12/1985 | Japan . |
| 60-252361 | 12/1985 | Japan . |

(List continued on next page.)

OTHER PUBLICATIONS

R.F. Fedors, "A Method for Estimating Both the Solubility Parameters and Molar Volumes of Liquids", Polymer Engineering and Science, vol. 14, No. 2, pp. 147–154 (Feb. 1974).

*Primary Examiner*—Mark Chapman
*Attorney, Agent, or Firm*—Fitzpatrick, Cella, Harper & Scinto

[57] ABSTRACT

The present invention provides an image forming method including the steps of: forming an electrostatic latent image on a latent image holding member; developing the electrostatic latent image by using a color toner to form a toner image; transferring the toner image onto a recording material; and fixing the toner image to the recording material by a heat fixing device including a heating member in contact with the toner image. In the method, the color toner contains at least a binder resin, a colorant and wax, the wax having a molecular weight distribution measured by GPC, which has a ratio of the weight average molecular weight (Mw) to the number average molecular weight (Mn) of 1.45 or less, and a solubility parameter (SP value) of 8.4 to 10.5. If the contact angles between the wax and the heating member at 100° C. and 200° C. are A and B, respectively, the contact angles A and B satisfy the following relations:

$$60° \leqq A \leqq 80°$$

$$10° \geqq B-A \geqq 3°.$$

140 Claims, 6 Drawing Sheets

FOREIGN PATENT DOCUMENTS

| | | |
|---|---|---|
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 1-185660 | 7/1989 | Japan . |
| 1-185661 | 7/1989 | Japan . |
| 1-185662 | 7/1989 | Japan . |
| 1-185663 | 7/1989 | Japan . |
| 1-238672 | 9/1989 | Japan . |
| 1-260460 | 10/1989 | Japan . |
| 2-79860 | 3/1990 | Japan . |
| 3-50559 | 3/1991 | Japan . |
| 3-91108 | 4/1991 | Japan . |
| 3-212652 | 9/1991 | Japan . |
| 3-242397 | 10/1991 | Japan . |
| 4-107467 | 4/1992 | Japan . |
| 4-149559 | 5/1992 | Japan . |
| 4-356057 | 12/1992 | Japan . |
| 6-123994 | 5/1994 | Japan . |
| 6-337540 | 12/1994 | Japan . |
| 6-337541 | 12/1994 | Japan . |
| 7-98511 | 4/1995 | Japan . |

IMAGE FORMING METHOD AND HEAT FIXING METHOD USING A TONER INCLUDING A WAX

BACKGROUND OF THE INVENTION

1. Field of the Invention

The present invention relates to an image forming method and heat fixing method which use an electrostatic image developing toner suitable for heat fixing and used in an electrophotographic process, an electrostatic recording process, and a magnetic recording process.

2. Related Background Art

Many conventional electrophotographic methods are known, such as the methods disclosed in U.S. Pat. No. 2,297,691 and Japanese Patent Publication Nos. 42-23910 and 43-24748. In the electrophotographic methods, generally, a latent image is formed on a photosensitive member by any one of various means using a photoconductive material, and then developed using toner to obtain a toner image. The developed image is then transferred onto a recording material such as paper or the like, by direct or indirect means according to demand, and fixed by heating, pressing, heating and pressing, or using solvent vapor to obtain a copy. The toner which remains untransferred on the recording material is cleaned off by any one of various methods. The foregoing steps may then be repeated.

A general method of forming a full color image is described. A photosensitive material of a photosensitive drum is uniformly charged by a primary charger so that an image is exposed to a laser beam modulated on the basis of a signal of a magenta image of an original to form an electrostatic latent image on the photosensitive drum, and the electrostatic latent image is developed by a magenta development unit containing a magenta toner to form a magenta toner image. The magenta toner image developed on the photosensitive drum is then transferred onto the conveyed transfer material by a transfer charger using direct or indirect means.

On the other hand, the photosensitive drum subjected to the development of the electrostatic latent image is discharged by a destaticizing charger, cleaned by cleaning means and then charged by the primary charger so that an electrostatic latent image of a cyan image is formed, developed with cyan toner, and transferred onto the transfer material having the magenta toner image transferred thereto by the same method as described above. A yellow toner image and a black toner image are successively transferred by the same method as described above to transfer the toner images having the four colors onto the transfer material. These toner images having the four colors which are transferred onto the transfer material are fixed by the action of heat and pressure of a fixing roller to form a full color image.

Such an apparatus has recently begun to be used in the fields of not only an official processing copying machine for simply copying general originals, but also a printer as an output device of a computer or a personal copy.

Besides the field of a laser beam printer, the apparatus is being applied rapidly to a plain paper facsimile which employs a similar basic engine.

Thus, there is a growing demand for an image forming apparatus of smaller size, lighter weight, higher speed, higher image quality and higher reliability, and fewer components. As a result, a toner is required to have higher performance, and an excellent machine cannot be attained unless improvement in performance of the toner used can be achieved. In recent years, demand for color copying has increased with diversification of needs for copying, and higher image quality and higher resolution have been demanded for more faithfully copying an original color image. From the above-described viewpoints, the toner used in the method of forming a color image is required to have good melting and color mixing properties when heat is applied thereto, and preferably has a low melting point, a low melt viscosity and sharp melt properties.

Namely, the use of such a toner having sharp melt properties permits the extension of the range of color reproduction of a copy and the formation of a color copy faithful to an original image.

However, such a color toner having excellent sharp melt properties generally has high affinity for the fixing roller and thus tends to easily cause offset to the fixing roller during fixing.

Particularly, in a fixing device in a color image forming apparatus, since a plurality of toner images including magenta toner, cyan toner, yellow toner and black toner images are formed on the transfer material, offset readily occurs due to the increase in the thickness of the toner layers.

Conventionally, in order to prevent adhesion of a toner to the roller surface, for example, the roller surface comprises a material having excellent release properties with respect to toner, such as silicone rubber or fluororesin, and the roller surface is further coated with a thin film of a liquid having high release properties, such as silicone oil or fluorocarbon oil, in order to prevent offset and fatigue of the roller surface.

Although this method is very effective to prevent offset of the toner, it has not only the problem of complicating the fixing device because of the need for a device for supplying an offset preventing liquid, but also the adverse effect that the oil coating causes release of the respective layers which form the fixing roller, and consequently decreases the life of the fixing roller. Various types of paper, coated paper and plastic films are generally used as the transfer material to which a toner image is fixed by using the fixing device. Particularly, there has recently been demand for a transparency film used as a transfer film for an overhead projector for presentation. Unlike paper, the transparency film has low oil absorption, and thus the transparency film having the resultant copy inevitably has a sticky feel due to the oil coating and has the unsolved important problem with respect to the quality of the obtained image. There are also the high possibilities of contaminating the inside of the copying machine with oil such as silicon oil when oil is evaporated by heat, and bringing about the problem with respect to treatment of the recovered oil.

Therefore, in order to supply an offset preventing liquid from the inside of the toner used during heating in place of the use of the device for supplying silicone oil, a method has been proposed in which a releasing agent such as low-molecular weight polyethylene or low-molecular weight polypropylene is added to the toner. However, when a large amount of such an additive is added for obtaining the sufficient effect, the photosensitive member is coated with a film, and the surfaces of toner holding members such as a carrier and a sleeve are contaminated, thereby causing the practical problem of deteriorating the obtained image. Thus, a small amount of releasing agent is added to the toner so as to prevent deterioration of the image, and a device for supplying a small amount of releasing oil or a device comprising a rolled member such as a web or a cleaning pad for cleaning off the offset toner is also used.

However, particularly for a full color image, when the transparency film is used as a transfer material, the means of adding the releasing agent to the toner causes the deterioration of the transparency and causes a haze to form on the transparency when the image is fixed, due to the high crystallization of the releasing agent and a difference between the refractive indexes of the releasing agent and the resin.

It is known that wax is added as a releasing agent to toner. This means is disclosed in, for example, Japanese Patent Publication Nos. 52-3304 and 52-3305 and Japanese Patent Laid-Open No. 57-52574.

The means of adding wax to toner is also disclosed in Japanese Patent Laid-Open Nos. 3-50559, 2-79860, 1-109359, 62-14166, 61-273554, 61-94062, 61-138259, 60-252361, 60-252360 and 60-217366.

Although wax is used for improving anti-offset properties of the toner used at high temperatures and low temperatures, and improving the fixing properties at low temperatures, wax has the problem of deteriorating anti-blocking properties and development properties due to exposure to an increased temperature in a copying machine or migration of wax to the toner surface when the toner is allowed to stand for a long time.

Conventional toners cannot solve all of these problems, and have problems of some kind. For example, some conventional toner has excellent anti-offset properties at high temperatures and development properties but has poor fixing properties at low temperatures, some toner has excellent anti-offset properties and fixing properties at low temperatures but has rather poor anti-blocking properties and deteriorating development properties at higher temperatures which may occur in the copying machine. Toner cannot satisfy anti-offset properties at both high temperatures and low temperatures. Moreover, some toner may cause extremely low OHP transparency.

In regard to OHP transparency, it has been proposed that a crystallization nucleator is added to wax in order to decrease crystallization of the wax itself (Japanese Patent Laid-Open Nos. 4-149559 and 4-107467), that wax having a low degree of crystallization is used (Japanese Application Nos. 3-091108 and 3-242397), and that a substance having good compatibility with a binder and lower melt viscosity than that of the binder is added to the binder so as to improve the surface smoothness of a toner layer after fixing (Japanese Application No. 3-212652).

An example of releasing agents having relatively good transparency and the low-temperature fixing ability is montan wax which is mineral wax.

It has been proposed in Japanese Patent Laid-Open Nos. 1-185660, 1-185661, 1-185662, 1-185663 and 1-238672 to use montan wax having a molecular weight of about 800 and represented by the following structural formula:

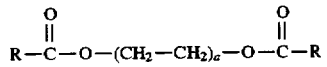

wherein R indicates a hydrocarbon group having 28 to 32 carbon atoms, and n indicates an integer. However, these proposals are not satisfactory from the viewpoints of OHP transparency and haze.

On the other hand, it is proposed in Japanese Laid Open Patent Nos. 7-98511, 6-337540, and 6-337541 to use ester type wax in which the structural symmetry of a releasing agent itself is broken for decreasing crystallinity of the releasing agent itself. This proposal produces good results.

However, a recent full color fixing device is also required to have high durability and high reliability. An image forming method which can be applied to not only images having a large image area but also images having a low image area and full color OHP cannot be easily stably realized for a long period of time only by improving the binder resin of toner and the releasing agent unless the fixing device is improved. It is thus desired to further improve the fixing device.

Japanese Patent Laid-Open No. 4-356057 (corresponding to U.S. Pat. No. 5,391,450) discloses that a heating member in contact with the toner image, comprises a fluorine-contained material, and non-polar wax having a molecular weight Mw of 500 to 1500 is added to toner. However, the non-polar wax such as paraffin wax or the like has poor compatibility (a small SP value) with the binder resin of the toner and easily decreases light transmission of a full color transparency image, thereby not always causing satisfactory effects.

Japanese Patent Laid-Open No. 6-123994 (corresponding to European Patent Application Publication No. 0587,540) discloses that wax having a ratio of Mw/Mn of 1.5 or less is added for satisfying both anti-blocking properties and fixing properties. However, unlike the present invention, this specification has the contents relating to magnetic toner, and no suggestion of the SP value of wax to be added to color toner, which is an important factor of transmission of a full color transparency image, and the value of contact angle with the heating member in contact with the toner image.

SUMMARY OF THE INVENTION

An object of the present invention is to provide an image forming method which can solve the above-described problems.

Another object of the present invention is to provide a heat fixing method and an image forming method which produce excellent fixation of a toner image to a recording material at low temperatures, the toner continuing anti-offset properties over a long period of time.

A further object of the present invention is to provide a heat fixing method and image forming method which are capable of fixing even when only a small amount of oil or no oil is coated.

A still further object of the present invention is to provide a heat fixing method and image forming method which can obtain a high-quality full color OHP image having excellent transparency.

In accordance with the objects of the present invention, there is provided in one aspect a heat fixing method comprising the steps of: holding a toner image formed by a color toner on a recording material; and fixing the toner image to the recording material, by using a heat fixing device comprising a heating member in contact with the toner image; wherein the color toner comprises at least a binder resin, a colorant and wax, the wax having a solubility parameter (SP value) of 8.4 to 10.5 and a molecular weight distribution measured by GPC, which has a ratio of the weight average molecular weight (Mw) to the number average molecular weight (Mn) of 1.45 or less, wherein if the contact angles at 100° C. and 200° between the wax and the heating member are A and B, respectively, the contact angles A and B satisfy the following relations:

$$60° \leqq A \leqq 80°$$

$$10° \geqq B-A \geqq 30°.$$

In another aspect of the present invention, there is provided an image forming method comprising the steps of:

forming an electrostatic latent image on a latent image holding member; developing the electrostatic latent image by using a color toner to form a toner image; transferring the toner image onto a recording material; and fixing the toner image to the recording material, by using a heat fixing device having a heating member in contact with the toner image; wherein the color toner comprises at least a binder resin, a colorant and wax, the wax having a solubility parameter (SP value) of 8.4 to 10.5 and a molecular weight distribution measured by GPC, which has a ratio of the weight average molecular weight (Mw) to the number average molecular weight (Mn) of 1.45 or less, wherein if the contact angles at 100° C. and 200° between the wax and the heating member are A and B, respectively, the contact angles A and B satisfy the following relations:

$$60° \leqq A \leqq 80°$$

$$10° \geqq B-A \geqq 3°.$$

DETAILED DESCRIPTION OF THE INVENTION

Figure 1:
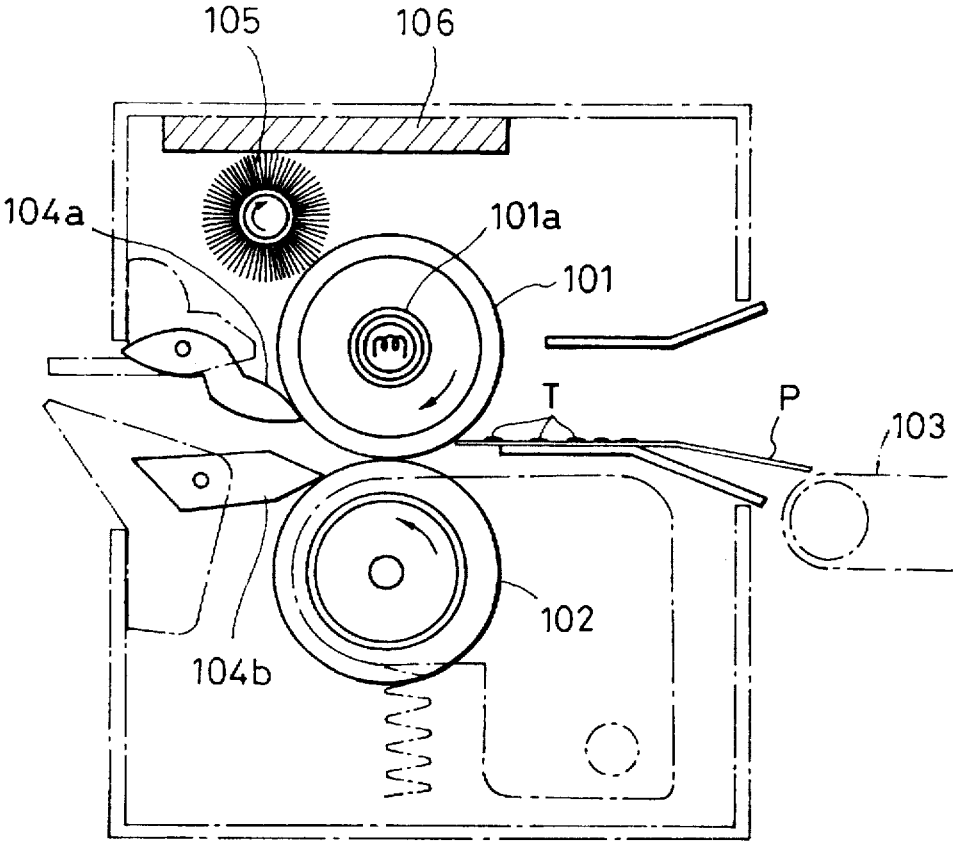
FIG. 1 is a schematic drawing illustrating a fixing device in a roller device in a roller heating system in accordance with an embodiment of the present invention.

As a result of intensive research, the inventors found that, when wax having a solubility parameter of 8.4 to 10.5 and a molecular weight distribution measured by gel permeation chromatography (GPC), which has a ratio of the weight average molecular weight (Mw) to the number average molecular weight (Mn) of 1.45 or less, is added to a toner, the toner exhibits excellent fluidity, can form a uniform fixed image without gloss nonuniformity, hardly contaminates the heating member of a fixing device and deteriorates storage properties, and produces a fixed image with excellent fixing properties and light transmission. It was also found that if the contact angle A at 100° between the wax and the heating member of the fixing device is within the range of 60° to 80°, the wax exhibits proper wettability for the heating member of the fixing device, and, when a full color OHP image having excellent transparency is formed by melting the toner, the heating member is thus appropriately coated with a part or the entire of the wax, thereby forming a full color OHP image without offset of the toner and manifesting good low-temperature fixing properties. In addition, it was further found that, when the difference between the contact angle A at 100° and the contact angle B at 200° C. is within the range of 3 to 10, good anti-offset properties can be maintained, and an increase of the life of the heating member can thus be realized.

Since no consideration is given to wettability by toner of a cleaning member such as a rolled member, e.g., a web, a cleaning pad or a cleaning roller, which contacts the surface of the heating member, a small amount of residual toner which adheres to the surface of the heating member cannot effectively be removed. However, it was further found that, if the contact angle C at 100° C. between the cleaning member in contact with the heating member and the wax contained in the toner is within the range of 0° to 60°, the wax which is finely dispersed in the unfixed toner or compatible with the binder easily adheres to the cleaning member, thereby effectively removing the residual offset toner from the heating member.

In the present invention, the contact angle was measured by a droplet method using CA-A model produced by Kyowa Kaimenkagaku in which a leaf (about 5 mm thick) of the surface layer material used for the heating member was formed.

In the present invention, if the contact angles at 100° C. and 200° C. between the wax contained in the toner and the heating member of the fixing device are A and B, respectively, contact angles A and B preferably satisfy the following relations:

$$60° \leqq A \leqq 80°$$

$$10° \geqq B-A \geqq 30°$$

and more preferably the following relations:

$$60° \leqq A \leqq 72°$$

$$9° \geqq B-A \geqq 4°$$

If contact angle A is less than 60°, the wax which is finely dispersed in the unfixed toner or compatible with the binder reaggregates, thereby decreasing color reproducibility or transmission of a full color OHP image. If contact angle A is over 80°, the wax cannot be uniformly coated on the heating member, and fixing nonuniformity and partial offset consequently occur, thereby producing defects in the image.

If the difference B−A between the contact angles is less than 3°, since the compatibility of the wax with the binder resin of the toner deteriorates, the fixing region is narrowed, and improvement in the transmission of the full color OHP image cannot be achieved. If the difference B−A is over 10°, when a recording material such as thick paper or a transparency film, which has a large heat capacity, is used, the wettability of the heating member with wax is changed by a large temperature change of the surface layer of the heating member, and thus a uniform glossy image cannot be obtained.

If the contact angle C exceeds 60°, the cleaning member has insufficient wettability with the toner, and thus the residual offset toner which adheres to the surface of the heating member cannot be effectively removed.

It is preferable from the viewpoints of the uniformity of the fixed image, good transfer properties of the toner and contamination of contact charging means for charging by contact with the photosensitive member that the wax contained in the toner used in the present invention has a molecular weight distribution measured by GPC using double columns, in which the ratio of the weight average molecular weight (Mw)to the number average molecular weight (Mn) is 1.45 or less, and more preferably 1.30 or less.

When the ratio Mw/Mn of the wax exceeds 1.45, since the fluidity of the toner deteriorates, nonuniformity in gloss of the fixed image, deterioration in transfer properties of the toner and contamination of the contact charging member easily occur.

In the present invention, the molecular weight distribution of wax is measured by GPC using double columns.

GPC measurement conditions

Apparatus: GPC-150C (produced by Waters Co.)

Column: two columns of GMH-HT 30 cm (produced by Toso Co.)

Temperature: 135° C.

Solvent: o-dichlorobenzene (containing 0.1% ionol added)

Flow rate: 1.0 ml/min.

Sample: injecting 0.4 ml of 0.15% sample

The molecular weight distribution is measured under the above conditions, and the molecular weight of a sample is calculated by using a molecular weight calibration curve which is formed by monodisperse polystyrene as a standard sample. The molecular weight is further converted to a molecular weight in terms of polyethylene by using a conversion equation derived from the Mark-Houwink viscosity equation.

The wax used in the present invention preferably has a solubility parameter (SP value) of 8.4 to 10.5, and more preferably 8.5 to 10.0. When wax having a SP value of less than 8.4 is used, the wax exhibits poor compatibility with the binder resin used and thus cannot be sufficiently dispersed in the binder resin, thereby narrowing the fixing region and causing insufficient transmission of a full color transparency image. When the SP value exceeds 10.5, blocking of toner particles easily occurs during storage for a long time, and a releasing layer is hardly formed between the fixing member and the toner binder resin layer in fixing due to the high compatibility between the binder resin and the wax, thereby easily causing the offset phenomenon.

In the present invention, the solubility parameters (SP value) of the wax and the binder resin are calculated by the Fedors' method which employs the additive property of atomic groups [Polym. Eng. Sci., 14(2), 147 (1974)].

In order to obtain an OHP image having sufficient transparency by the fixing device with a low heat capacity, it is important to decrease the crystallinity of the wax to be contained in the toner. The presence of grain boundaries of toner particles remaining unmelted after fixing, and the crystallinity of the wax layer, decrease effective light transmission due to light irregular reflection, thereby decreasing haze. In addition, even if the components mixed in the toner are sufficiently melted during fixing, after melting, irregular reflection of light undesirably occurs due to the large difference between the refractive indexes of the toner layer and the wax layer formed between the toner layer and the fixing member.

An increase in irregular reflection of light is related to decreases in brightness and color sharpness of a projected image. Particularly, when a reflection type overhead projector is used, this problem with respect to irregular reflection becomes more critical than it is when a transmission type overhead projector is used.

Namely, it is important for decreasing the crystallinity of wax to decrease the degree of crystallinity of the wax itself. In addition, in order to prevent the presence of grain boundaries of unmelted toner in the fixed toner layer, it is preferable to match the glass transition temperature (Tg) of the binder resin to the melting point (mp) of the wax as much as possible. It is also preferable for rapidly melting with low energy to use a material having a low melting enthalpy (ΔH) which is the latent heat of the wax. Further, in order to rapidly transfer the melted wax layer to a portion between the binder resin layer and the fixing member to form an offset preventing layer, it is preferable to appropriately adjust a difference between the solubility parameters (SP values) of the binder resin and the wax.

From the above viewpoints, preferred embodiments of the present invention are described in detail below.

Examples of toner binder resins which are preferably used in the present invention include polyester resins, styrene-acrylic resins, epoxy resins and styrene-butadiene resins. Therefore, the wax used preferably has a refractive index close to that of the resin used.

An example of methods of measuring the refractive index is a method in which a solid sample having a size of 20 to 30 mm long, 8 mm wide and 3 to 10 mm thick is formed, and placed on a prism surface to which a small amount of bromonaphthalene is applied for improving adhesion between the sample and the prism surface. The measuring apparatus is Abbe refractometer 2T produced by Atago Co.

It is effective that the difference between the refractive indexes of the binder resin and the wax is 0.18 or less, and more preferably 0.10 or less, at a temperature of 25° C. When the difference between the refractive indexes exceeds 0.18, the transparency of an OHP image deteriorates, and particularly, the brightness of a half tone image undesirably decreases.

The wax used in the present invention preferably has a melting point of 30° to 150° C., and more preferably 50° to 120° C. The use of wax having a melting point of lower than 30° C. easily deteriorates the anti-blocking properties of the toner, and the prevention of contamination of the sleeve and the photosensitive member during copying on many sheets. When the melting point of the wax used exceeds 150° C., excessive energy is required for uniformly mixing the binder resin and the wax in the production of the toner by grinding. In the production of the toner by polymerization, since the viscosity must be increased for uniformly mixing the wax in the binder resin, the size of the apparatus is increased, or the amount of the wax compatible with the binder resin is limited. It is thus undesirably difficult to add a large amount of wax.

The melting point of the wax used in the present invention is the temperature at a main peak in an endothermic curve measured in accordance with ASTM D3418-8.

In measurement according to ASTM D3418-8, for example, DSC-7 produced by Perkin Elmer Co is used. The temperature of a detection portion of the apparatus is corrected by using the melting points of indium and zinc, and the quantity of heat is corrected by using the heat of melting of indium. Measurement is performed by using a an aluminum pan for a sample and an empty pan set as a control at a rate of temperature rise of 10° C./min. within the temperature range of 20° to 200° C.

The wax compound used in the present invention preferably has a melt viscosity of 1 to 50 m Pas·sec, and more preferably 3 to 30 mPas·sec, at 10° C. When the wax used has a melt viscosity of less than 1 mPas·sec, in a one-component development system in which a toner thin layer is coated on the sleeve by a member such as an elastic blade for restricting the thickness of the toner layer by elastic force, the sleeve is readily contaminated by mechanical shearing force. In a two-component development method, when a toner image is developed by using a carrier, the toner image is easily damaged due to shearing force between the toner and the carrier, thereby easily burying external additives in the toner and breaking the toner. When the melt viscosity of the wax exceeds 50 mPas·sec, in the production of a toner by polymerization, fine toner particles having a uniform particle size cannot easily be obtained because of the excessively high viscosity of the disperse phase, thereby producing a toner having a wide particle size distribution.

An example of methods of measuring the melt viscosity of the wax used in the present invention uses VT-500 produced by HAAKE Corp. and a cone plate type rotor (PK-1).

It is effective that the wax used in the present invention preferably has Vickers hardness within the range of 0.3 to 5.0, and more preferably within the range of 0.5 to 3.0.

A toner containing wax having Vickers hardness of less than 0.3 is easily crushed in a cleaning portion of a copying machine during copying on many sheets, and fusing of the toner easily occurs on the drum surface, thereby producing black stripes in an image. In addition, when many image samples are stacked and stored, the toner is transferred onto the back of a sheet, thereby easily causing so-called offset. A toner containing wax having Vickers hardness over 5.0 causes the need to apply high pressure to the fixing unit used for heat fixing, and the fixing unit must thus be designed to have excessive strength. Further, fixing by using the fixing unit with usual pressure easily causes deterioration in anti-offset properties.

An example of methods of measuring the hardness of wax uses Shimazu Dynamic Microfine Hardness Meter (DUH-200). Vickers hardness is measured by the method in which a Vickers indentor is displaced by 10 μm under a load of 0.5 g at a load rate of 9.67 mg/sec, and is then held for 15 seconds, and a mark on a sample is analyzed to determine Vickers hardness. The sample is formed by melting and then molding using a mold having a diameter of 20 mm to form a cylindrical shape having a thickness of 5 mm.

The wax used in the present invention preferably has a degree of crystallization of 10 to 50%, and more preferably 20 to 35%. When the wax has a degree of crystallization of less than 10%, the storage properties and fluidity of a toner readily deteriorate. When the wax has a degree of crystallization of over 50%, the transparency of an OHP image readily deteriorates.

The degree of crystallinity of the wax used in the present invention is calculated from an area ratio between the amorphous scattering peak and the crystal scattering peak by the following equation without using a calibration curve:

$$\text{Degree of crystallinity (\%)} = \frac{\text{Amount of crystal component}}{\text{Total amount of components}}$$

An example of measurement apparatus is Rotor Flex RU300 (Cu target, pint focus, output of 50 KV/250 mA) produced by Rigaku Denki Co. Measurement is performed by a transmission-rotation method using a measurement angle of $2\theta=5°$ to $35°$.

As described above, the wax used in the present invention preferably has good low-temperature fixing properties, proper affinity for the binder resin so as to exhibit anti-offset properties, high hydrophobic nature and a low melting point and low degree of crystallinity.

In addition, the wax used in the present invention preferably has a molecular weight distribution measured by GPC, which has at least two peaks or at least one peak and at least one shoulder, a weight average molecular weight (Mw) of 200 to 2000, and a number average molecular weight (Mn) of 150 to 2000. Such a molecular weight distribution may be achieved by using either a single type of wax or a plurality of types of wax. It was found that the above molecular weight distribution can decrease crystallinity and further improve transparency. The method of blending at least two types of wax is not limited, and at least two kinds of wax can be blended by, for example, melt blending using a medium type dispersing machine (a ball mill, a sand mill, an attritor, an apex mill, a COBOL mill or a handy mill) at a temperature higher than the melting points of wax to be blended, or dissolving wax to be blended in a polymerizable monomer and then blending using a medium type dispersing machine. In this blending, additives such as a pigment, a charge controlling agent and a polymerization initiator may be added.

The wax used preferably has a weight average molecular weight (Mw) of 200 to 2000 and a number average molecular weight (Mn) of 150 to 2000, more preferably Mw of 200 to 1500 and Mn of 200 to 1500, and most preferably Mw of 300 to 1000 and Mn of 250 to 1000. When the wax has Mw of less than 200 and Mn of less than 150, the anti-blocking properties of the toner deteriorate. When the wax has Mw and Mn of over 2000, the wax itself manifests crystallinity, thereby decreasing transparency.

The wax is preferably mixed in an amount of 1 to 40 parts by weight, and preferably 2 to 30 parts by weight, relative to 100 parts by weight of toner binder resin.

In the grinding method for producing toner in which a mixture containing a binder resin, a colorant and wax is melted and kneaded, and then cooled, ground and classified to obtain toner particles, the amount of the wax added is preferably 1 to 10 parts by weight, and more preferably 2 to 7 parts by weight, relative to 100 parts by weight of binder resin.

In the polymerization method for producing toner in which toner particles are obtained directly by polymerization of a mixture containing a polymerizable monomer, a colorant and wax, the amount of the wax added is preferably 2 to 30 parts by weight, more preferably 5 to 30 parts by weight, and most preferably 10 to 20 parts by weight, relative to 100 parts by weight of polymerizable monomer or the resin synthesized by polymerization of a polymerizable monomer.

In the polymerization method for producing toner, since the wax used has lower polarity than that of the binder resin, a large amount of wax can easily be included in the toner particles by polymerization in an aqueous medium, as compared with the grinding method for producing toner. It is thus possible to use a great amount of wax, and the use of a large amount of wax is particularly effective to obtain the effect of preventing offset, as compared with the grinding method.

If the amount of the wax added is less than the lower limit, the effect of preventing offset easily decreases, and, if the amount of the wax added exceeds the upper limit, the anti-blocking effect deteriorates, and the anti-offset effect is adversely affected, thereby easily causing fusing on the drum and the sleeve. Particularly, the polymerization method tends to produce a toner having a wide particle size distribution.

Examples of wax which can be used in the present invention include paraffin wax, polyolefin wax, modification products thereof such as oxides and grafting products, higher fatty acids, metal salts thereof, amide wax, ester wax, and the like.

Of these wax materials, ester wax is particularly preferable in that a full color OHP image having high quality can be obtained.

The ester wax which is preferably used in the present invention is produced by, for example, synthesizing by oxidation, synthesizing from a carboxylic acid or a derivative thereof, employing reaction for introducing an ester group, typically, Mickel addition reaction. A more preferable method for producing the wax used in the present invention employs a dehydrocondensation reaction of a carboxylic acid compound and an alcohol compound as shown by the formula (1) below, or reaction of an acid halide and an alcohol compound, as shown by the formula (2) below.

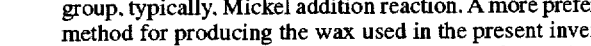

$$R_1—COOH+R_2(OH)_n \leftrightharpoons R_2(OCO—R_1)_n+nH_2O \quad (1)$$

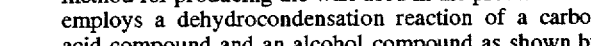

$$R_1—COCl+R_2(OH)_n \leftrightharpoons R_2(OCO—R_1)_n+nHCl \quad (2)$$

wherein $R_1$ and $R_2$ each indicate an organic group such as an alkyl group, an alkenyl group, an acyl group or an aromatic group; and n indicates an integer of 1 to 4. An organic group preferably has 1 to 50 carbon atoms, more preferably 2 to 45 carbon atoms, and most preferably 4 to 30 carbon atoms, and is preferably a straight chain.

In order to transfer the above ester equilibrium reaction into the production system, excessive alcohol is used, or a Dean-Stark water separator is used in an aromatic organic solvent which is azeotropic with water. Another method of synthesizing polyester can also be employed in which a base is added as an acceptor for an acid secondarily produced by using an acid halide in the aromatic organic solvent.

Examples of binder resins which can be used for toner in the present invention include the following:

Homopolymers of styrene and substituted styrene, such as polystyrene, poly-p-chlorostyrene, polyvinyltoluene and the like; styrene copolymers such as styrene-p-chlorostyrene copolymers, styrene-vinyltoluene copolymers, styrene-vinylnaphthalene copolymers, styrene-acrylate copolymers, styrene-methacrylate copolymers, styrene-methyl-α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers and the like; polyvinyl chloride; phenolic resins; natural modified phenolic resins; natural resin-modified maleic acid resins; acrylic resins; methacrylic resins, polyvinyl acetate; silicone resins; polyester resins; polyurethane; polyamide resins; furan resins; epoxy resins; xylene resins; polyvinyl butyral; terpene resins; cumarone-indene resins; petroleum resins, and the like. Preferable examples of binder materials include styrene copolymers and polyester resins.

Examples of comonomers for styrene monomer of styrene copolymers include unsubstituted or substituted monocarboxylic acids having a double bond, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, acrylamide, and the like; unsubstituted or substituted dicarboxylic acids having a double bond, such as maleic acid, butyl maleate, methyl maleate, dimethyl maleate, and the like; vinyl esters such as vinyl chloride, vinyl acetate, vinyl benzoate, and the like; ethylenic olefins such as ethylene, propylene, butylene, and the like; vinyl ketones such as vinyl methyl ketone, vinyl hexyl ketone, and the like; vinyl ethers such as vinyl methyl ether, vinyl ethyl ether, vinyl isobutyl ether, and the like. These vinyl monomers are used singly or in a mixture of at least two monomers.

The THF soluble content of the toner binder resin used in the present invention preferably has a number average molecular weight of 3,000 to 1,000,000.

Styrene polymers or styrene copolymers may be crosslinked, or used in a resin mixture of crosslinked resin and uncrosslinked resin.

A compound having at least two polymerizable double bonds may be used as a crosslinking agent for the binder resin. Examples of such crosslinking agents include aromatic divinyl compounds such as divinylbenzene, divinylnaphthalene and the like; carboxylates having two double bonds, such as ethylene glycol diacrylate, ethylene glycol dimethacrylate, 1,3-butanediol dimethacrylate, and the like; divinyl compounds such as divinyl aniline, divinyl ether, divinyl sulfide, divinyl sulfone, and the like; and compounds having at least three vinyl groups. These compounds are used singly or in a mixture of at least two compounds. The amount of the crosslinking agent added is preferably 0.001 to 10 parts by weight relative to 100 parts by weight of polymerizable monomer.

The toner used in the present invention may contain a charge controlling agent.

Examples of materials for controlling the toner to negative charge include the following:

Organometallic compounds and chelate compounds are effective, and monoazo metallic compounds, acetylacetone metallic compounds, and metallic compounds of aromatic hydroxycarboxylic acids and aromatic dicarboxylic acids are preferably used. Other examples include aromatic hydrocarboxylic acids, aromatic mono- or poly-carboxylic acids and metallic salts, anhydrides and esters thereof, phenol derivatives thereof such as bisphenol, urea derivative, metal-containing salicylic compounds, metal-containing naphthoic compounds, boron compounds, tertiary ammonium salts, Calyx arene, silicon compounds, styrene-acrylic acid copolymers, styrene-methacrylic acid copolymers, styrene-acrylic-sulfonic acid copolymers, and nonmetallic carboxylic acid compounds.

Examples of materials for controlling the toner to positive charge include nigrosine; fatty acid metallic salt-modified products; guanidine compounds; imidazole compounds; tertiary ammonium salts such as tributylbenzyl ammonium-1-hydroxy-4-naphthosulfonate, tetrabutylammonium tetrafluoroborate, and the like, and onium salts such as phosphonium salts similar to the ammonium salts; lake pigments of the tertiary ammonium salts or onium salts; triphenylmethane dyes and lake pigments thereof (lake forming agents) such as tungstophosphoric acid, phosphomolybdic acid, tungstophosphomolybdic acid, tannic acid, lauric acid, gallic acid, ferricyanide and ferrocyanide; metallic salts of higher fatty acids; diorganotin oxides such as dibutyltin oxide, dioctyltin oxide, dicyclohexyltin oxide, and the like; diorganotin borates such as dibutyltin borate, dioctyltin borate, dicyclohexyltin borate, and the like. These compounds can be used singly or in a mixture of at least two compounds. Of these charge controlling agents, nigrosine and tertiary ammonium salts are particularly preferable in respect to good rising of charge.

The amount of the charge controlling agent used is 0.01 to 20 parts by weight, more preferably 0.1 to 10 parts by weight, and most preferably 0.2 to 4 parts by weight, relative to 100 parts by weight of toner resin component.

The toner colorant used in the present invention is toned to black by using carbon black as a block colorant, a magnetic material and the yellow, magenta or cyan colorant which will be described below.

As the yellow colorant, condensed azo compounds, isoindolinone compounds, anthraquinone compounds, azo metal complexes, methine compounds, and arylamide compounds can be used. Preferable examples of such yellow colorants include C. I. Pigment Yellow 12, 13, 14, 15, 17, 62, 74, 83, 93, 94, 95, 109, 110, 111, 128, 129, 147, 168 and 180.

As the magenta colorant, condensed azo compounds, diketopyrrolopyrrole compounds, anthraquinone, quinacridone compounds, basic dye lake compounds, naphthol compounds, benzimidazolon compounds, thioindigo compounds, and perylene compounds can be used. Preferable examples of such magenta colorants include C. I. Pigment Red 2, 3, 5, 6, 7, 23, 48:2, 48:3, 48:4, 57:1, 81:1, 144, 146, 166, 169, 177, 184, 185, 202, 206, 220, 221 and 254.

As the cyan colorant, copper phthalocyanine compounds and derivatives thereof, anthraquinone compounds, and basic dye lake compounds can be used. Preferable examples of such cyan colorants include C. I. Pigment Blue 1, 7, 15, 15:1, 15:2, 15:3, 15:4, 60, 62 and 66. These colorants can be used singly or in a mixture, or in the state of a solid solution. The colorant used in the present invention is selected in consideration of the hue angle, chroma, brightness, weather resistance, OHP transparency and dispersibility in the toner. The amount of the colorant added to the toner used in the present invention is preferably 1 to 20 parts by weight relative to 100 parts by weight of resin.

The toner contains a magnetic material so that it can also be used as a magnetic toner. In this case, the magnetic material can also act as a colorant. Examples of magnetic materials which are contained in the magnetic toner include iron oxides such as magnetite, hematite and ferrite; metals such as iron, cobalt and nickel; alloys and mixtures thereof with metals such as aluminum, cobalt, copper, lead, magnesium, tin, zinc, antimony, beryllium, bismuth, cadmium, calcium, manganese, selenium, titanium, tungsten and vanadium.

The magnetic material used in the present invention is preferably subjected to surface modification. When the magnetic toner is produced by the polymerization method, the magnetic material is preferably subjected to surface modification by using a surface modifier which does not inhibit polymerization of the polymerizable monomer. Examples of such surface modifiers include silane coupling agents and titanium coupling agents.

A ferromagnetic material as the magnetic material preferably has an average particle size of not more than 2 μm, and more preferably about 0.1 to 0.5 μm. The amount of the magnetic material contained in the magnetic toner is preferably 10 to 200 parts by weight, and more preferably 20 to 100 parts by weight, relative to 100 parts by weight of resin component.

With application of a magnetic field of 10K oersted, the magnetic material preferably has magnetic characteristics in that coercive force (Hc) is 20 to 300 oersted, saturation magnetization ($\sigma s$) is 50 to 200 emu/g, and remanent magnetization ($\sigma r$) is 2 to 20 emu/g.

Additives for providing the toner with various characteristics preferably have a particle size of not more than ⅕ of the volume average size of the toner particles from the view point of the durability when they are contained in or added to the toner. The particle size of the additives represents the average particle size determined by observing the surfaces of the toner particles under an electron microscope. Examples of such additives used for providing characteristics include the following:

Examples of fluidity providing agents include metallic oxides such as silicon oxide, aluminum oxide, and titanium oxide; carbon black; and fluorocarbon. These agents are more preferably made hydrophobic.

Examples of abrasives include metallic oxides such as strontium titanate, cerium oxide, aluminum oxide, magnesium oxide and chromium oxide; nitrides such as silicon nitride; carbides such as silicon carbide; metal salts such as calcium sulfate, barium sulfate and calcium carbonate.

Examples of lubricants include powders of fluorocarbon resins such as polyvinylidene fluoride and polytetrafluoroethylene; fatty acid metal salts such as zinc stearate and calcium stearate.

Examples of charge controlling particles include particles of metallic oxides such as tin oxide, titanium oxide, zinc oxide, silicon oxide and aluminum oxide; and carbon black.

These additives are preferably used in an amount of 0.1 to 10 parts by weight, more preferably 0.1 to 5 parts by weight, relative to 100 parts by weight of toner particles. These additives may be used singly or in a mixture of a plurality of additives.

Description will now be made of the method of producing the toner used in the present invention.

The toner used in the present invention can be produced by the grinding production method or the polymerization production method.

In the grinding production method, the binder resin, wax, a pigment, a dye or a magnetic material as a colorant, and, if required, the charge controlling agent and other additives, are sufficiently mixed by a mixer such as a Henschel mixer, a ball mill or the like, the resultant mixture is melted and kneaded by using a heat kneader such as a heating roll, a kneader, an extrusion kneader or the like to disperse or dissolve the metallic compounds, pigment, dye or magnetic material in the melt of the resin components, and the thus-obtained mixture is solidified by cooling, ground and classified to obtain toner particles.

If required, the toner and a desired additive are further sufficiently mixed by a mixer such as a Henschel mixer to obtain the toner used in the present invention.

Examples of the polymerization toner production method include the method disclosed in Japanese Patent Publication No. 56-13945 in which a melt mixture is atomized in air by using a disk or a multiple fluid nozzle to obtain spherical toner particles; the method disclosed in Japanese Patent Publication No. 36-10231 and Japanese Patent Laid-Open Nos. 59-53856 and 59-61842 in which toner particles are produced directly by using suspension polymerization; an emulsion polymerization method, i.e., a dispersion polymerization method in which toner particles are produced directly by using an aqueous organic solvent in which a monomer is soluble and the obtained polymer is insoluble, or a soap free polymerization method in which toner particles are produced directly by polymerization in the presence of a water soluble polar polymerization initiator; and a method in which primary polar particles are formed by emulsion polymerization, and polar particles having opposite charge are added to and associated with the primary polar particles by a hetero aggregation method to produce toner particles. of these methods, the method of producing toner particles by directly polymerizing a monomer composition containing at least a polymerizable monomer, a colorant and wax is preferred.

However, although the dispersion polymerization method produces toner exhibiting a very sharp particle size distribution, the selection of the materials used is limited, and the use of the organic solvent complicates the production apparatus used due to disposal of the waste solvent and flammability of the solvent. The method of producing toner particles by directly polymerizing a monomer composition containing at least a polymerizable monomer, a colorant and wax in an aqueous medium is more preferable.

However, although the emulsion polymerization method, i.e., the soap free polymerization method, is effective because the toner particles have a relatively uniform particle size distribution, when the terminals of the emulsifying agent and initiator are present on the surfaces of the toner particles, environmental characteristics easily deteriorate.

Therefore, the suspension polymerization method in atmosphere or under pressure is preferred because fine toner particles having a sharp particle size distribution can relatively easily be obtained. A so-called seed polymerization method can also preferably be used in which a monomer is further adsorbed on the toner particles previously obtained by polymerization, followed by polymerization using a polymerization initiator.

The toner used in the present invention preferably has a form in which the wax is involved in the shell resin layer of the toner, as shown in measurement by a section measurement method using a transmission electron microscope (TEM). Since a great amount of toner must be contained in the toner from the viewpoint of fixing properties, it is preferable for the storage properties and fluidity of the toner that the wax is involved in the shell resin layer. If the wax is not involved in the shell layer of the toner, the wax cannot be uniformly dispersed, and thus the particle size distribution is widened, and fusing of the toner to the apparatus easily occurs. A typical method of involving wax in the toner is a method in which the polarity of the wax used in an aqueous medium is set to be smaller than that of the main monomer, and a small amount of resin or monomer having high polarity is further added to the mixture to obtain a toner having a so-called core shell structure in which the wax is coated with the shell resin layer. The particle size distribution and particle size of the toner can be controlled by changing the types and the amounts of the water insoluble inorganic salt and dispersant having the function as protective colloid, which are added to the toner, or controlling mechanical apparatus conditions such as the peripheral speed of a rotor and the number of paths, agitation conditions such as the shape of an agitating blade, the shape of a container or the solid content of an aqueous solution, to obtain the predetermined toner of the present invention.

A typical method of measuring sections of the toner particles used in the present invention is a method in which the toner particles are sufficiently dispersed in an epoxy resin curable at room temperature, and then cured at a temperature of 40° C. for 2 days to obtain a curing product which is then dyed with triruthenium tetroxide or, if required, combination with triosmium tetroxide, and cut by using a microtome provided with diamond teeth to obtain a leaf sample, followed by measurement of the sectional form of the toner by using a transmission electron microscope (TEM). In the present invention, the method of dyeing with triruthenium tetroxide is preferable for providing a contrast between the materials by employing a small difference between the degrees of crystallinity of the wax used and the resin of the shell resin layer.

When the direct polymerization method is used as the method of producing toner of the present invention, the toner can be produced by the production method below. Wax, a colorant, a charge controlling agent, a polymerization initiator and other additives are added to a monomer, and the resultant mixture is then uniformly dissolved or dispersed by a dispersing machine such as a homogenizer or an ultrasonic dispersing machine to obtain a monomer system. The thus-obtained monomer system is dispersed in an aqueous phase containing a dispersion stabilizer by a usual agitator or a dispersing machine such as a homomixer or a homogenizer. The agitation speed and time are preferably adjusted so that monomer droplets have a desired toner particle size to form toner particles. Agitation may be then performed so as to maintain the state of the particles and prevent sedimentation of the particles by the action of the dispersion stabilizer. The polymerization temperature is set to 40° C. or more, and preferably 50° to 90° C. The temperature may be increased in the latter stage of polymerization reaction. In the latter stage of reaction or after the completion of reaction, the aqueous medium is preferably partly distilled off for removing the unreacted polymerizable monomer and by-products which cause odor in fixing the toner. After the completion of reaction, the produced toner particles are washed, recovered by filtration, and then dried. In the suspension polymerization method, generally, 300 to 3000 parts by weight of water relative to 100 parts by weight of monomer is preferably used as the dispersion medium.

Preferable examples of polymerizable monomers used for obtaining the toner directly by using the polymerization method include styrene monomers such as styrene, o (m-, p-)-methylstyrene, m (p-)-ethylstyrene, and the like; (metha) acrylate monomers such as methyl (metha)acrylate, ethyl (metha)acrylate, propyl (metha)acrylate, butyl (metha) acrylate, octyl (metha)acrylate, dodecyl (metha)acrylate, stearyl (metha)acrylate, behenyl (metha)acrylate, 2-ethylhexyl (metha)acrylate, dimethylaminoethyl (metha) acrylate, diethylaminoethyl (metha)acrylate,and the like; ethylenic monomers such as butadiene, isoprene, cyclohexene, (metha)acrylonitrile, acrylamide, and the like.

In order to provide the toner with the core shell structure in the present invention, it is preferable to combine a polar resin. Examples of polar resins such as polar polymers and polar copolymers which can be used in the present invention are given below.

Polymers of nitrogen-containing monomers such as dimethylaminoethyl methacrylate, diethylaminoethyl methacrylate, and the like; copolymers of the nitrogen-containing monomers and styrene-unsaturated carboxylates; polymers of nitrile monomers such as acrylonitrile, halogen monomers such as vinyl chloride, unsaturated carboxylic acids such as acrylic acid and methacrylic acid, unsaturated dibasic acids, unsaturated dibasic anhydrides and nitro monomers, and copolymers of these monomers and styrene monomers; polyesters and epoxy resins. Copolymers of styrene and (metha)acrylic acid, maleic acid copolymers, unsaturated polyester resins and epoxy resins are more preferable.

Examples of polymerization initiators include azo or diazo polymerization initiators such as 2,2'-bisazo-(2,4-dimethylvaleronitrile), 2,2'-azobisisobutyronitrile, 1,1'-azobis(cyclohexane-1-carbonitrile), 2,2'-bisazo-4-methoxy-2,4-dimethylvaleronitrile and azobisisobutyronitrile and the like; peroxide initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane and tris-(t-butylperoxy)triazine, and the like; polymer initiators having peroxides in side chains thereof; persulfates such as potassium persulfate, ammonium persulfate, and the like; and hydrogen peroxide. These compounds can be used singly or in a mixture of at least two compounds.

The amount of the polymerization initiator added is preferably 0.5 to 20 parts by weight relative to 100 parts by weight of polymerizable monomer.

A known crosslinking agent and chain transfer agent may be added for controlling the molecular weight. These additives are preferably added in an amount of 0.001 to 15 parts by weight relative to 100 parts by weight of polymerizable monomer.

In production of the toner by the polymerization method which employs emulsion polymerization, dispersion polymerization, suspension polymerization or hetero aggregation, a suitable inorganic compound or organic compound is preferably added as a stabilizer to the dispersion medium. Examples of inorganic compounds as stabilizers include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, and alumina. Examples of organic compounds as stabilizers include polyvinyl alcohol, gelatin, methyl cellulose, methylhydroxypropyl cellulose, ethyl cellulose, sodium salt of carboxymethyl cellulose, polyacrylic acid and salts thereof, starch, polyacrylamide, polyethylene oxide, poly(hydroxystearic acid-g-methyl methacrylate-eu-methacrylic acid) copolymer, and nonionic or ionic surfactants.

In the emulsion polymerization method or hetero aggregation method, an anionic surfactant, a cationic surfactant, an ampholytic ionic surfactant or a nonionic surfactant is used as the stabilizer. The stabilizer is preferably used in an amount of 0.2 to 30 parts by weight relative to 100 parts by weight of polymerizable monomer.

When an inorganic compound among these stabilizers is used, a commercial stabilizer may be used, or an inorganic compound as a stabilizer may be produced in a dispersion medium in order to obtain fine particles.

In order to finely disperse the stabilizer, a surfactant may be used in an amount of 0.001 to 0.1 part by weight relative to 100 parts by weight of polymerizable monomer. The surfactant is used for promoting the stabilization function of the dispersion stabilizer. The surfactant is added for promoting stabilization of the dispersion stabilizer. Examples of such stabilizers include sodium dodecylbenzenesulfate, sodium tetradecylsulfate, sodium pentadecylsulfate, sodium octylsulfate, sodium oleate, sodium laurate, potassium stearate, and calcium oleate.

When the toner is produced by the polymerization method, care must be taken to the property of inhibiting polymerization and the property of transferring to a water phase, both of which are possessed by the colorant used, and thus the colorant is preferably subjected to surface modification, e.g., treatment for making the colorant hydrophobic so as not to inhibit polymerization. Particularly, since a dye and carbon black frequently have the property of inhibiting polymerization, care must be taken to the use of these colorants. A preferable example of surface treatment methods for dyes is a method in which a polymerizable monomer is previously polymerized in the presence of a dye, and the resultant colored polymer is added to the monomer system. Carbon black may be treated by the same method as that for dyes or treated with a substance such as polyorganosiloxane which reacts with the surface functional groups of carbon black.

It is preferable for the toner used in the present invention that the wax and the binder resin have a proper difference between the SP values thereof. Specifically, the SP value of the binder resin is higher than that of the wax, and the difference between the SP values is preferably 6.0 to 15.0, and more preferably 7.0 to 14.0.

With a difference between the SP values of less than 6.0, the wax easily appears on the toner surfaces, thereby not only deteriorating the storage properties of the toner and but also contaminating the charging member. When the difference between the SP values exceeds 15.0, dispersibility (compatibility) of the wax in the binder resin deteriorates, thereby deteriorating the dispersibility of the colorant and thus hardly obtaining toner having a uniform coloring ability.

The SP value of the binder resin is preferably 16 to 24, and more preferably 17 to 23. When the binder resin has a SP value of less than 16, rising by contact with the charging member such as the carrier deteriorates, thereby causing fogging and toner scattering. When the binder resin has a SP value of over 24, particularly, at high humidity, the charging ability of the toner deteriorates, thereby deteriorating image quality.

The wax contained in the toner has a melting point higher than the glass transition temperature of the binder resin, and the temperature difference therebetween is preferably 100° C. or less, more preferably 75° C. or less, and most preferably 50° C. or less. With a temperature difference exceeding 100° C., the low temperature fixing properties deteriorate. When the temperature difference is excessively small, the temperature region where the toner can maintain both the storage properties and high temperature anti-offset properties is narrowed. Thus, the temperature difference is preferably not less than 2° C.

The glass transition temperature of the binder resin is preferably 40° to 90° C., and more preferably 50° to 85° C.

When the binder resin has a glass transition temperature of less than 40° C., the storage properties and fluidity of the toner deteriorate, and thus a good image cannot be obtained. When the binder resin has a glass transition temperature of over 90° C., the low-temperature fixing properties and light transmission of a full color transparency image deteriorate. Particularly, a half tone portion becomes dull, and a projected image without chroma is obtained.

The glass transition temperature (Tg) of the binder resin is measured by, for example, using DSC-7 produced by Perkin Elmer Corp. in accordance with ASTM D3418-8. The temperature of a detection portion of the apparatus is corrected by using the melting points of indium and zinc, and the quality of heat is corrected by using the heat of fusion of indium. Measurement is performed by using an aluminum pan for a sample and an empty pan for a control at a rate of temperature rise of 10° C./min. within the temperature range of 20° to 200° C.

The toner of the present invention can be used as both a mono-component developing agent and a two-component developing agent.

When a magnetic toner comprising a toner containing a magnetic material is used as a mono-component developing agent, the magnetic toner is transferred and charged by employing a magnet contained in a development sleeve. When a nonmagnetic toner containing no magnetic material is used as a mono-component developing agent, the toner is transferred by adhering the toner to the development sleeve by forced fractional electrification using a blade and a fur brush.

When a toner is used as a two-component developing agent, a toner and a carrier are used. The carrier used in the present invention is not limited, and oxides of metals such as iron, copper, zinc, nickel, cobalt, manganese, chromium, and the like can be used as the carrier singly or in a composite ferrite state. The shape of the carrier is also important in the point that saturation magnetization and electric resistance can widely be controlled. For example, a spherical, flat or irregular shape is selected. It is also preferable to control the micro-structure of the surface of the carrier, for example, surface irregularity.

The carrier can be obtained by a method in which carrier core particles are previously formed by firing and grading a metallic oxide, and then coated with a resin, or a method in which, in order to decrease the load of the carrier on the toner, an inorganic oxide and a resin are kneaded together, and then ground and classified to obtain a low-density inorganic oxide disperse carrier, or a method in which a kneaded mixture of an inorganic oxide and a monomer is directly subjected to suspension polymerization in an aqueous medium to obtain a spherical inorganic oxide disperse carrier.

The form in which the surface of the carrier is coated with a resin is particularly preferred. As the coating method, a method of coating the carrier with a resin by dissolving or suspending a coating material in a solvent, and any conventional methods of coating a carrier with a resin, e.g., a method of simply mixing powders, can be used.

The coating material used for coating the surface of the carrier depends upon the toner material used. Examples of such coating materials include polytetrafluoroethylene, monochlorotrifluoroethylene, polyvinylidene fluoride, silicone resins, polyester resins, metallic compounds of di-tertiary butyl salicylate, styrene resins, acrylic resins, polyamide, polyvinyl butyral, nigrosine, aminoacrylate resins, basic dyes and lake thereof, silica fine powders, alumina fine powders,and the like. These materials are used individually or combination of a plurality of materials.

The amount of the coating material used (coated) is preferably 0.01 to 30% by weight, and more preferably 0.1 to 20% by weight, of the weight of the carrier after treatment.

The average particle size of the carrier is preferably 10 to 100 μm, and more preferably 20 to 50 μm.

A particularly preferable form of the carrier is a coated ferrite carrier which is formed by coating ferrite surfaces with (i) a mixture of a fluororesin and a styrene resin (for example, a combination of polyvinylidene fluoride and styrene-methyl methacrylate resin, a combination of polytetrafluoroethylene and styrene-methyl methacrylate resin or a combination of a fluoro-copolymer and a styrene copolymer) preferably at a ratio of 90:10 to 20:80, and more preferably at a ratio of 70:30 to 30:70, or (ii) a silicon resin preferably at a concentration of 0.01 to 5% by weight, and more preferably at a concentration of 0.1 to 3% by weight. Examples of fluoro-copolymers include vinylidene fluoride-tetrafluoroethylene copolymers (10:90 to 90:10). Examples of styrene copolymers include styrene-2-ethylhexyl acrylate copolymers (20:80 to 80:20), and styrene-2-ethylhexyl acrylate-methyl methacrylate copolymers (20 to 60:5 to 30:10 to 50).

The coated ferrite carrier has a sharp particle size distribution and the effects of obtaining electrification properties preferable for the toner used in the present invention and improving electrophotographic properties.

When a two-component developing agent is prepared by mixing the toner and the carrier, mixing 1 to 15% by weight of the toner in the developing agent produces good results. When the toner content is less than 2% by weight, the image density is decreased. When the toner content exceeds 15% by weight, fogging and scattering in the apparatus are increased, thereby decreasing the service life of the developing agent.

The carrier preferably has the following magnetic characteristics. The saturation magnetization is preferably 20 to 90 $Am^2/kg$, and more preferably 30 to 70 $Am^2/kg$ for achieving higher image quality. With saturation magnetization of over 90 $Am^2/kg$, a high-quality toner image cannot be obtained, and with saturation magnetization of less than 20 $Am^2/kg$, adhesion of the carrier readily occurs due to a decrease in magnetic restraint.

Description will now be made of a preferable heat fixing device used for the image forming method and heat fixing method of the present invention.

In a heat fixing device of the present invention, a heating member in contact with a toner image contacts the toner image held on a recording material to apply heat for fixing the toner image to the recording material. The heating member includes (i) a heating roller as a roller member in a heating roller fixing system described below in which the heating roller contacts a toner image and applies heat of heating means provided therein to the toner image, (ii) a fixing film as a film member in a film heat fixing system in which the fixing film contacts a tone image and applies heat of heating means provided on the side of the heating film opposite to the side thereof which contacts the toner image, and (iii) a fixing film as a film member in a film heat fixing system in which the fixing film contacts a toner image and applies heat generated from the film member due to electromagnetic induction caused by the action of a magnetic field.

FIG. 1 is a schematic drawing illustrating a heat fixing device in a roller heat fixing system in accordance with an embodiment of the invention.

This apparatus comprises a cylindrical heating roller 101 containing heating means such as a heater 101*a*, the heating roller 101 being rotated clockwise during fixing.

A pressure roller 102 comprises a cylindrical pressure rotating member and is rotated counterclockwise in pressure contact with the heating roller 101 during fixing.

Recording material P as a material to be heated to which a toner image comprising unfixed toner T adheres is conveyed from the right side (upstream side) in the drawing by a conveyor belt 103, and then pressed and heated in a pressure contact portion between the heating roller 101 and the pressure roller 102. As a result, the unfixed toner image held on the recording material P is fixed to the recording material P by the heating roller 101 serving as a heating member in pressure contact with the toner image, and then delivered to the left side (downstream side) in the drawing.

Separation claws 104*a* and 104*b* are used for separating the recording material P so as to prevent the recording material P from winding around the heating roller 101 or the pressure roller 102 and causing conveyance error.

A felt-like oil pad 106 is impregnated with a releasing agent such as silicone oil having suitable viscosity, and a cleaning roller 105 has brush fibers planted therein in a cylindrical form. The cleaning roller 105 is rotated to remove residual toner which adheres to the peripheral surface of the heating roller 101 and appropriately supply the releasing agent to the heating roller 101. The felt-like oil pad 106 may be omitted.

The heating roller 101 comprises an aluminum pipe having a thickness of about 2 to 5 mm and serving as a core metal, the peripheral surface thereof being coated with silicone rubber or Teflon having a thickness of 200 to 500 μm.

The pressure roller 102 comprises a SUS pipe of about 10 mmϕ, for example, and serving as a core metal, the peripheral surface thereof being coated with silicone rubber having a thickness of about 3 mm.

Figure 5:
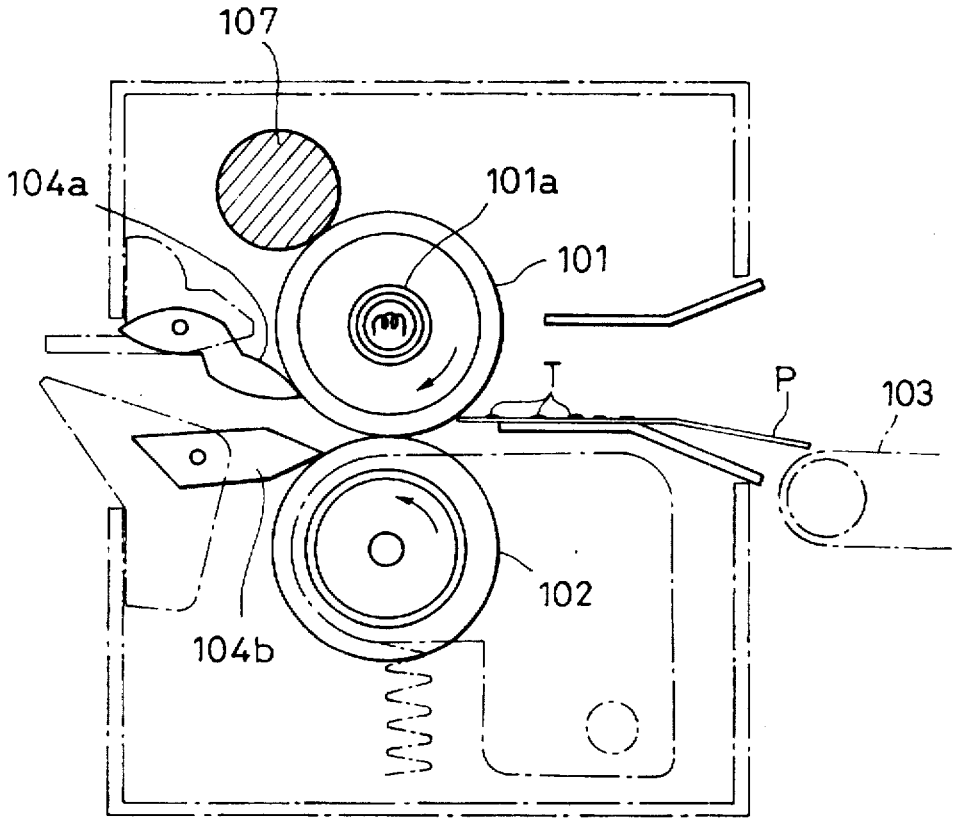
FIG. 5 is a schematic drawing illustrating a fixing device in a roller heating system in accordance with a further embodiment of the present invention.

FIG. 5 is a schematic drawing illustrating a heat fixing device in a roller heat fixing system in accordance with another embodiment of the present invention.

In the heat fixing device shown in FIG. 5, a cleaning roller 107 is substituted for the cleaning roller 105 shown in FIG. 1, comprising the brush fibers planted therein to form a cylindrical shape in the roller heat fixing device. The cleaning roller 107 includes silicone rubber, fluororubber or fluororesin which is formed in a cylindrical shape, and the felt-like oil pad 106 is omitted. The same components as those shown in FIG. 1 are denoted by the same reference numerals.

In the heat fixing device shown in FIG. 5, the cleaning roller 107 is rotated to remove residual toner which adheres to the peripheral surface of the heating roller. Since the cleaning roller 107 as a cleaning member has contact angle C at 100° C. with the wax contained in the toner, within the range of 0° to 60°, as described above, the residual toner which adheres to the peripheral surface of the heating roller can effectively be removed by the cleaning roller 107.

In the present invention, a heat fixing device in a film heat fixing system can be used in place of the heat fixing device in a roller heat fixing system.

Compared with other known heat fixing devices such as devices in a roller heating system, a heating plate system, a belt heating system, a flash heating system and an oven heating system, the heat fixing device in a film heat fixing system has the following advantages:

(1) Since this device can use a linear heating member with a low heat capacity as a heating member, and a thin film with a low heat capacity, it is possible to achieve power saving and a short wait time (quick start), and prevent an increase in the temperature in the device;

(2) It is possible to set the fixing point and the separation point separately, and thus prevent offset;

(3) It is possible to solve various problems of other systems.

The heat fixing device in a film heat fixing system can be used as not only the fixing device but also heat treatment means and devices for a material to be heated, such as a device for modifying the surface properties of a recording material holding an image, a pre-fixing device, and the like.

Figure 2:
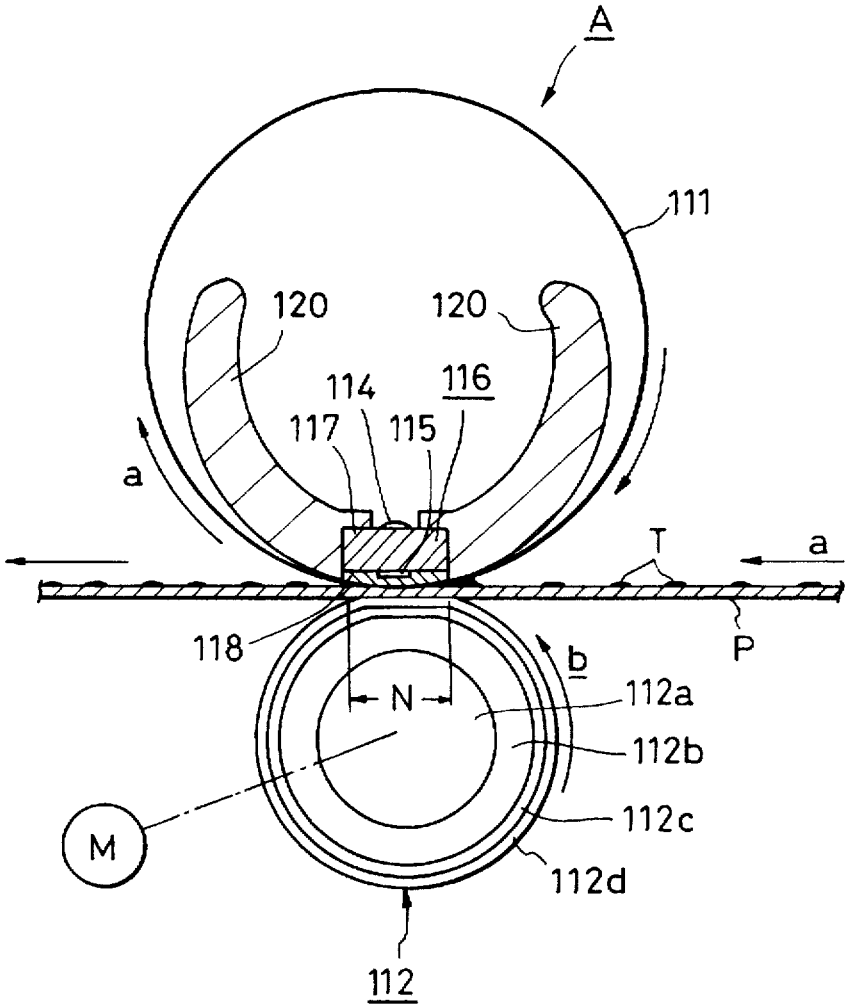
FIG. 2 is a schematic drawing illustrating a fixing device in a film heating system in accordance with another embodiment of the present invention.

FIG. 2 schematically shows a device (an image heat fixing device A) in a film heat fixing system.

Reference numeral 116 denotes a heating member (ceramic heater) fixed and supported by a support (not shown). A heat-resistant film (fixing film) 111 is adhered to the heating member 116 by a pressure roller 112 serving as a pressure rotating member. Recording material P is guided through the image heat fixing device A by guides 120. Recording material P as a material to be heated to which an image is fixed is introduced between the heat resistant film 111 and the pressure roller 112 in a pressure contact nip portion (fixing nip portion) N which is formed by the heating member 116 and the pressure roller 112 as the pressure rotating member with the heat resistant film 111 held therebetween. Both recording material P and the heat resistant film 111 are conveyed in a direction a while being held in the pressure contact nip portion N to heat and fix unfixed toner image T held on the recording material P to the recording material P by applying the heat of the pressing member 116 to the recording material P through the heat resistant film 111. Namely, the unfixed toner image held on the recording material P is fixed to the recording material P by the fixing film 111 as a heating member in contact with the toner image. After the recording material P is passed through the pressure contact nip portion N, it is separated from the surface of the film 111 and then conveyed.

The heating member 116 is a linear heating member having a low heat capacity, comprising a long thin substrate 117 having heat resistance, insulating properties, good thermal conductivity and the lengthwise direction perpendicular to the direction a of conveyance of the heat resistant film 111 or the recording material P as a material to be heated; a resistance heat generator 115 provided on the widthwise central portion of the surface of the substrate 117 along the lengthwise direction thereof; feeder electrodes (not shown in the drawing) provided at both ends of the resistance heat generator 115 in the lengthwise direction thereof; a heat resistant overcoat layer 118 for protecting the surface of the heating member 116 which restricts the resistance heat generator 115; and a temperature detecting element 114 such as a thermistor provided on the back of the substrate, for detecting the temperature of the heating member 116.

The heating member 116 is bonded to a heater support having rigidity and heat resistance to be held thereby in the state wherein the surface side on which the resistance heat generator 115 is provided is exposed downward.

When electricity is supplied from the electrodes at both ends of the resistance heat generator 115, the temperature of the heating member 116 is increased by the heat generated from the resistance heat generator 115 over the whole length thereof. The temperature increase is detected by the temperature detecting element 115, and the detected temperature is fed back to a temperature control circuit (not shown) to control electrical supply to the resistance heat generator 115 so that the temperature of the heating member 116 is maintained at a predetermined value. Namely, electrical supply to the resistance heat generator 115 is controlled so that the detection output of the temperature detecting element (thermistor) 114 is kept constant during fixing. A heating device which employs injection of an alternating magnetic field can be used as the heating member in place of the ceramic heater.

The heat resistant film 111 may have the form of an endless belt which is wound around a roller serving as a driving roller so that the film 111 is rotated and conveyed by frictional force between the driving roller and the inner peripheral surface of the film 111, a form in which the pressure roller 112 is also used as a driving roller or a driving roller other than the pressure roller 112 is brought into contact with the outer surface of the film 111 so that the film 111 is rotated and conveyed by frictional force between the driving roller and the outer peripheral surface of the film 111, or a form in which the heat resistant film 111 is made a rolled long film so as to be delivered and conveyed.

The pressure roller 112 as a rotating pressure member is the same as the pressure contact roller 112 of the heat fixing device in the roller heating system shown in FIG. 1. The pressure roller 112 is a solid elastic roller (referred to as a "solid roller" hereinafter) comprising a metal core **112*a* and a heat resistant rubber layer 112*b* made of silicone rubber or the like which has good releasing properties. The pressure roller 112 is brought into pressure contact with the surface of the heating member 116 with the film 111 held therebetween under predetermined pressure by bearing means or urging means (not shown). When the pressure roller 112 is also used as the film driving roller, rotational force is transmitted to the roller 112 from driving means (not shown) to rotate the roller 112** in the counterclockwise direction shown by an arrow b.

A preferable form of the heating roller as the heating member is an elastic roller comprising the heat resistant rubber layer **112*b* as a base layer, an outermost surface layer comprising a fluororesin layer 112*d* having a specified contact angle with the wax contained in the toner, and a fluororubber layer 112*c* formed between the base layer and the outermost surface layer and having hardness higher than that of the heat resistant rubber layer 112*b*** and a thickness of 5 to 10 μm. The fluororesin of the uppermost surface layer more preferably contains FEP (tetrafluoroethylene-hexafluoropropylene copolymer) as a main component.

The elastic roller constructed as described above has excellent releasing properties over a long period of time and good adhesive force between the respective layers, and is thus excellent in durability and capable of maintaining low roller hardness.

A preferable form of the heat fixing device in the film heating system in accordance with the present invention is a heat fixing device comprising the elastic roller as the rotating pressure member so that the recording material P as the material to be heated is introduced into the portion between the heat resistant film and the rotating pressure member in the pressure contact nip portion which is formed by the heating member and the rotating pressure member with the heat resistant film held therebetween, and conveyed together with the heat resistant film through the pressure contact nip portion to apply the heat of the heating member to the material to be heated through the heat resistant film, as shown in FIG. 2.

Figure 6:
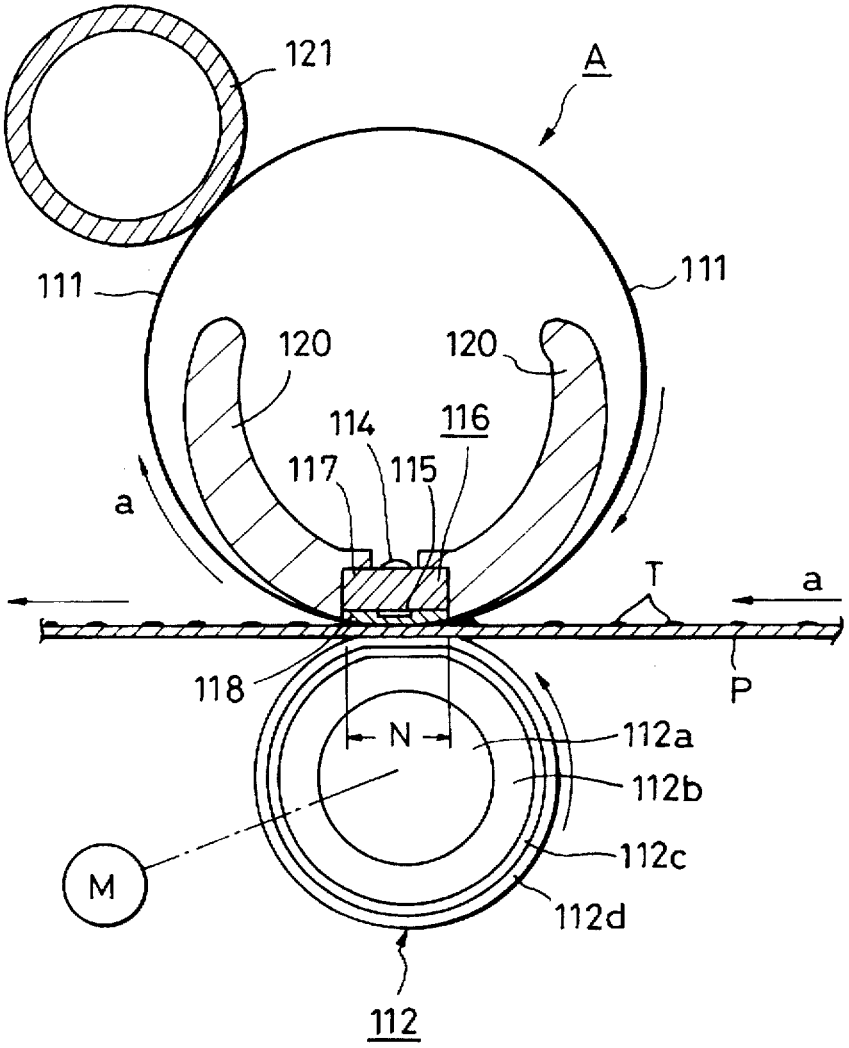
FIG. 6 is a schematic drawing illustrating a fixing device in a film heating system in accordance with a further embodiment of the present invention.

FIG. 6 is a schematic drawing illustrating a heat fixing device in the film heat fixing system in accordance with a further embodiment of the present invention.

The heat fixing device shown in FIG. 6 comprises the same components as those of the heat fixing device shown in FIG. 2 and also includes a cleaning roller 121. The same components as those shown in FIG. 2 are respectively denoted by the same reference numerals.

The cleaning roller 121 comprises, for example, a pipe-formed substrate such as an iron hollow pipe, and a tube made of a resin material such as a PEA resin and provided on the surface of the substrate. The PEA resin contains a filler so as to adjust the contact angle.

In the heat fixing device shown in FIG. 6, the cleaning roller 121 is rotated in contact with the surface of the heat-resistant film 111 to remove the residual toner which adheres to the surface of the heat-resistant film 111.

Since the cleaning roller 121 serving as the cleaning member has contact angle C at 100° C. with the wax contained in the toner within the range of 0° to 60°, as described above, the residual toner which adheres to the surface of the heat-resistant film can effectively be removed by the cleaning roller 121.

Another preferable form of the heat fixing device in the film heating system is a heating device comprising a heat resistance member such as a heat resistant film or belt having a conductive layer, a pressure member having a conductive layer and alternating magnetic field generating means for generating an eddy current by generating a magnetic field in these conductive layers to generate heat therein so that the recording material as the material to be heated is held and conveyed in the pressure contact nip portion between the heat resistant member and the pressing member to heat the recording material.

A preferable form of the heat resistant member such as the heat resistant film or belt serving as the heating member comprises the outermost surface layer consisting of a fluororesin as a main component, and an elastic layer provided on the inner side of the surface layer.

Therefore, in any one of the heat fixing device in the roller heating system, the heat fixing device in the film heating system and other heat fixing devices, the heating member in pressure contact with the unfixed toner image held on the recording material must satisfy the above-specified relations of the contact angle with the wax contained in the toner. Thus, the outermost surface layer of the heating member preferably comprises a copolymer having at least tetrafluoroethylene as a repeating unit in side chains of the copolymer, and more preferably comprises a FEP or PEA (tetrafluoroethyleneperfluoroalkyl vinyl ether) copolymer having at least one of a fluoroalkoxy group, a fluoroalkyl group, and the fluoroalkoxy and fluoroalkyl groups in side chains of the copolymer. In order to prevent contamination with the toner, the heating member preferably comprises FEP copolymer having fluoroalkyl groups in the side chains of the copolymer.

The heat fixing method according to the present invention comprises the steps of holding the toner image formed by a color toner on the recording material, and fixing the unfixed toner image held on the recording material to the recording material by the heat fixing device having the heating member in pressure contact with the toner image. The above-described heat fixing device is used in the fixing step.

The image forming method according to the present invention comprises the steps of forming an electrostatic latent image on a latent image holding member, developing the electrostatic latent image by using a color toner to form a toner image, transferring the toner image onto the recording material, and fixing the unfixed toner image held on the recording material to the recording material by the heat fixing device having the heating member in pressure contact with the toner image. The heat fixing device is used in this fixing step.

An example of the image forming method of the present invention is described in detail below with reference to FIG. 3.

Figure 3:
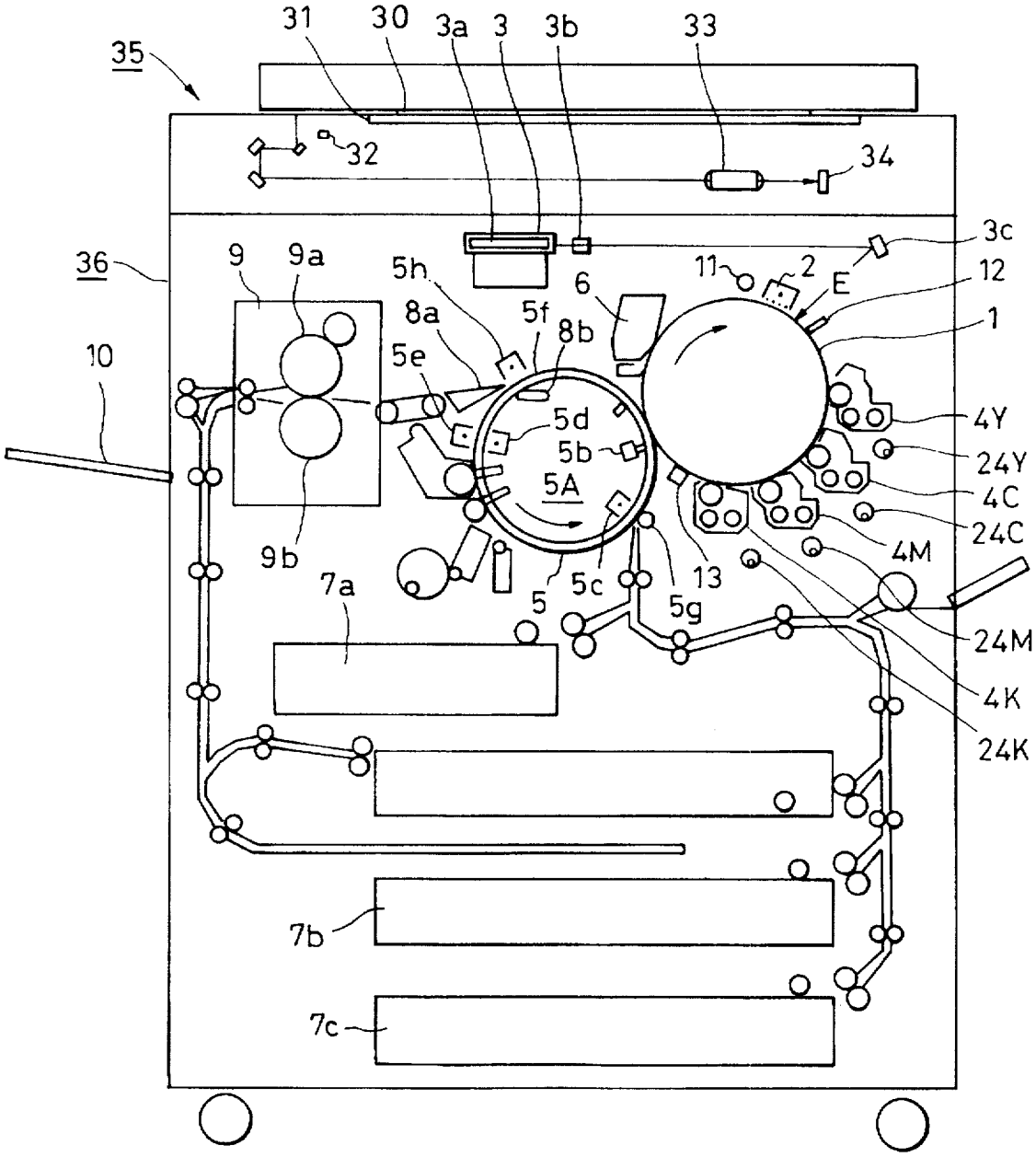
FIG. 3 is a schematic drawing illustrating an image forming apparatus used in an image forming method in accordance with a still another embodiment of the present invention.

FIG. 3 is a schematic drawing illustrating the construction of an image forming apparatus to which the image forming method of the present invention can be applied.

This image forming apparatus is used as a full color copying machine. The full color copying machine comprises an upper digital color image reader unit 35, and a lower digital color image printer unit 36, as shown in FIG. 3.

In the image reader unit, an original 30 is placed on an original glass base 31, and is exposed and scanned by an exposure lamp 32, and the light reflected from the original 30 is converged to a full color sensor 34 by a lens 33 to obtain a color separation image signal. The color separation image signal is passed through an amplifying circuit (not shown) and then processed by a video processing unit (not shown) to be sent to the digital image printer unit.

In the image printer unit, a photosensitive drum 1 as a latent image holding member comprises a photosensitive member such as an organic photoconductive member and is provided so as to be rotatable in the direction shown by an arrow. A pre-exposure lamp 11, a corona charger 2 as a primary charging member, a laser exposure optical system 3 as latent image forming means, a potential sensor 12, four developing devices 4Y, 4C, 4M and 4K having different colors, drum light detecting means 13, a transfer device 5A and a cleaning device 6 are disposed around the photosensitive drum 1.

In the laser exposure optical system 3, the image signal output from the reader unit is converted into an optical signal derived from scanning exposure of the image by a laser output unit (not shown) to generate a laser beam which is reflected by a polygon mirror 3*a* and projected to the surface of the photosensitive drum 1 through a lens 3*b* and a mirror 3*c*.

In the printer unit, in image formation, the photosensitive drum 1 is rotated in the direction shown by an arrow so as to be destaticized by the pre-exposure lamp 11 and then uniformly negatively charged by the charger 2, and light E is applied for each of the separated colors to form a latent image on the photosensitive drum 1.

The latent image is developed by operating a predetermined developing device to form a visible image, i.e., a toner image, on the photosensitive drum 1 by using a resin-based negative toner. In development, the developing devices 4Y, 4C, 4M and 4K are selectively brought near to the photosensitive drum 1 by operating eccentric cams 24Y, 24C, 24M and 24K according to the separated colors.

The transfer device 5A comprises a transfer drum 5, a transfer charger 5b, an attraction charger 5c for electrostatically attracting the recording material and an attraction roller 5g opposite thereto, an internal charger 5d, an external charger 5e and a separation charger 5h. The transfer drum 5 is axially rotatably supported, and a transfer sheet 5f as a recording material bearing member for bearing the recording material is integrally provided in an open area of the peripheral surface thereof. The transfer sheet 5f comprises a polycarbonate film.

The recording material is conveyed to the transfer drum 5 from a recording cassette 7a, 7b or 7c through a recording material conveyance system, and is borne on the transfer sheet 5f. The recording material borne on the transfer drum 5 is repeatedly conveyed to a transfer position opposite to the photosensitive drum 1 with rotation of the transfer drum 5 to transfer the toner image formed on the photosensitive drum 1 onto the recording material by the action of the transfer charger 5b during passage through the transfer position.

The aforementioned image forming steps are repeated for yellow (Y), magenta (M), cyan (C) and black (K) to obtain a transferred color image by superposing toner images having the four colors on the recording material on the transfer drum 5.

In the image formation on one side of the recording material, as described above, the recording material onto which the toner images having four colors are transferred is separated from the transfer drum 5 by the action of a separation claw 8a, a separation pushing-up roller 8b and the separation charger 5h, and then sent to a heat fixing device 9. The heat fixing device 9 comprises a heat fixing roller 9a containing heating means, and a pressure roller 9b. The recording material is passed through the pressure contact portion between the heat fixing roller 9a as a heating member and the pressure roller 9b to fix the full color image borne on the recording material to the recording material. Namely, a full color permanent image is formed by color mixing and color development of the toners, and fixing to the recording material in the fixing step, and is then delivered to a tray 10 to complete copying of a full color image. On the other hand, residual toner on the surface of the photosensitive drum 1 is cleaned off by the cleaning device 6, the photosensitive drum 1 is then subjected to the image forming process again.

In the image forming method of the present invention, the toner image obtained by developing the electrostatic latent image formed on the latent image bearing member may be transferred onto the recording material through an intermediate transfer member. Namely, this image forming method comprises the steps of transferring the toner image formed by developing the electrostatic latent image formed on the latent image bearing member onto the intermediate transfer member, and transferring the toner image transferred onto the intermediate transfer member onto the recording material.

An example of the image forming method using the intermediate transfer member is described in detail below with reference to FIG. 4.

Figure 4:
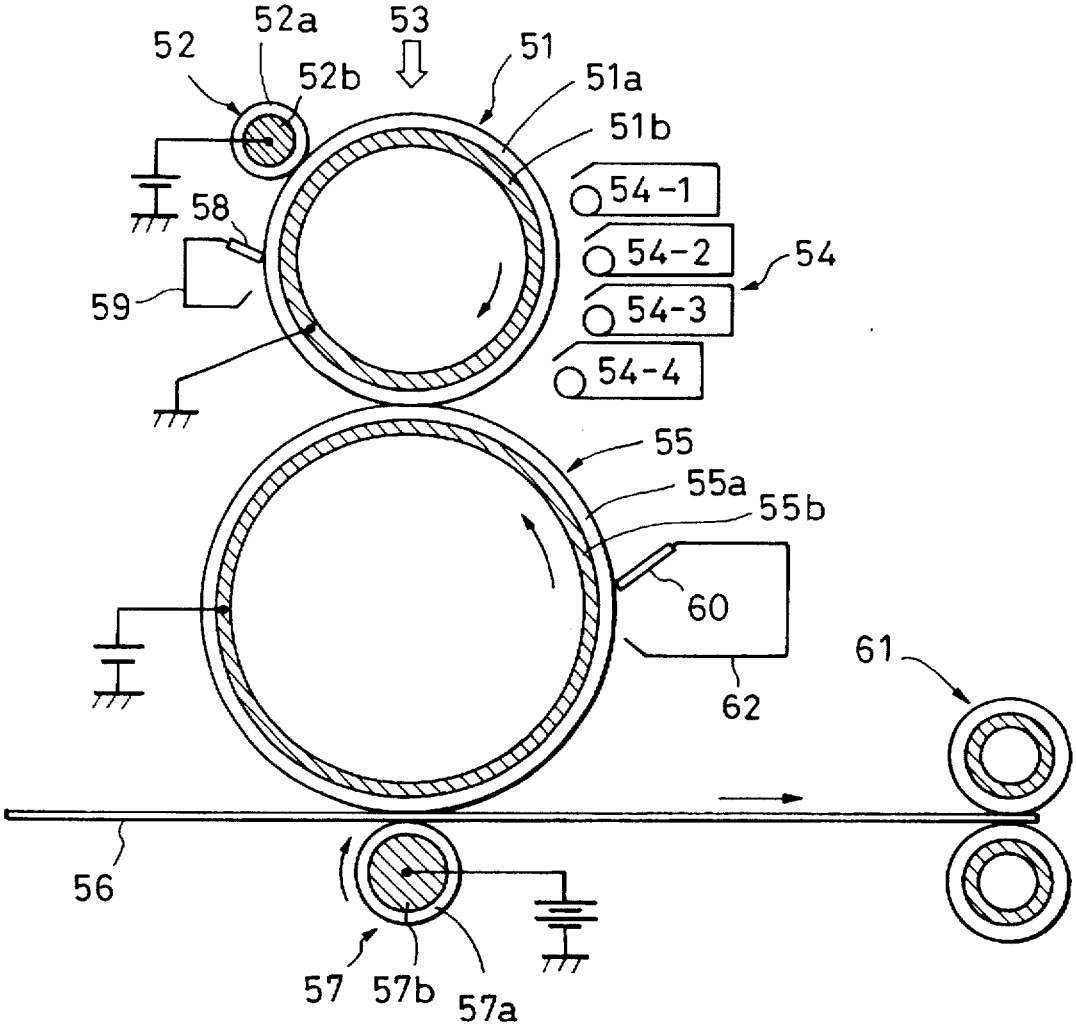
FIG. 4 is a schematic drawing illustrating an image forming apparatus comprising an intermediate transfer member used in the image forming method in accordance with a further embodiment of the present invention.

In the device system shown in FIG. 4, a cyan developing agent containing a cyan toner, a magenta developing agent containing a magenta toner, a yellow developing agent containing a yellow toner, and a black developing agent containing a black toner are introduced into a cyan developing device 54-1, a magenta developing device 54-2, a yellow developing device 54-3 and a black developing device 54-4, respectively. An electrostatic latent image is formed on a photosensitive member 51 serving as the latent image holding member, by latent image forming means such as a laser beam. The electrostatic image formed on the photosensitive member 51 is developed by a development method using these developing agents, such as a magnetic brush development method, a nonmagnetic monocomponent development method or a magnetic jumping development method, to form a toner image having each of the colors on a photosensitive member 51. The photosensitive member 51 comprises a photosensitive drum or photosensitive belt having a conductive substrate 51b, and a layer 51a of a photoconductive insulating material such as amorphous selenium, cadmium sulfide, zinc oxide, an organic photoconductor, amorphous silicon, or the like formed on the conductive substrate 51b. The photosensitive member 51 is rotated in the direction shown by an arrow by a driving device (not shown). The photosensitive member 51 preferably comprises an amorphous silicon photosensitive layer or organic photosensitive layer.

The organic photosensitive layer may be a single layer type comprising a single photosensitive layer containing a charge generating substance and a substance having the charge transport ability, or a separate function type photosensitive layer comprising a charge transport layer and a charge generating layer as components. Another preferable example of the organic photosensitive layer is a laminated photosensitive layer having a structure in which a charge generating layer and a charge transport layer are laminated in this order on a conductive substrate.

The binder resin for the organic photosensitive layer is preferably a polycarbonate resin, a polyester resin or an acrylic resin because such resins have good cleaning properties and hardly cause poor cleaning, toner fusing to the photosensitive member and filming.

The charging step is performed by a non-contact method using a corona charger which does not contact the photosensitive member 51, or a contact method using a contact charging member such as a roller. In order to effectively uniformly charge, simplify the device and decrease the generation of ozone, the contact method is preferably used, as shown in FIG. 4.

A charging roller 52 as a primary charging member basically comprises a central core metal 52b, and a conductive elastic layer 52a formed on the outer periphery thereof. The charging roller 52 is pressed on the surface of the photosensitive roller 51 to be rotated in linkage with rotation of the photosensitive member 51.

When the charging roller is used, the charging process is preferably performed under conditions in which the contact pressure of the roller is 5 to 500 g/cm, and, when a DC voltage is superposed on an AC voltage, the AC voltage is 0.5 to 5 kvpp, the AC frequency is 50 to 5 kHz, and the DC voltage is ±0.2 to ±5 kV.

Other contact charging members include a charging blade and a conductive brush. These contact charging members have the effects of eliminating the need for a high voltage and decreasing the generation of ozone.

A preferable material for the charging roller and charging blade as the contact charging members is conductive rubber. A releasing film may be provided on the surface of the charging member, and a nylon resin, PVDE (polyvinylidene fluoride), PCDV (polyvinylidene chloride) and fluoroacrylic resin can be used as the material for the releasing film.

The toner image on the photosensitive member is transferred onto an intermediate transfer member 55 to which a voltage, e.g., ±0.1 to ±5 kV, is applied. The intermediate transfer member 55 comprises a pipe-formed conductive core metal 55*b*, and an elastic layer 55*a* formed on the outer periphery thereof and having a medium resistance. The core metal 55*b* may be formed by providing a conductive layer, e.g., conductive plating, on a plastic surface.

The elastic layer 55*a* with a medium resistance is a solid or foamed layer which is prepared by blending and dispersing a conductivity additive such as carbon black, zinc oxide, tin oxide, or silicon carbide in an elastic material such as silicone rubber, Teflon rubber, chloroprene, urethane rubber, or EPDM (ethylene-propylenediene terpolymer) so that the electric resistance is adjusted to a medium value of $10^5$ to $10^{11}$ Ωcm.

The intermediate transfer member 55 is axially supported in parallel with the photosensitive member 51 so as to contact the lower surface of the photosensitive member 51. The intermediate transfer member 55 is rotated in the counterclockwise direction shown by an arrow at the same peripheral speed as the photosensitive member 51.

In the step of passing a toner image of a first color borne on the surface of the photosensitive member 51 through the transfer nip portion between the photosensitive member 51 and the intermediate transfer member 55, the toner image is transferred onto the outer surface of the intermediate transfer member 55 by the electric field formed in the transfer nip portion by applying a transfer bias to the intermediate transfer member 55. Residual toner on the photosensitive member 51, which was not transferred to the intermediate transfer member 55, is cleaned off by a cleaning member 58 for the photosensitive member, and recovered by a cleaning container 59 for the photosensitive member.

Transfer means is axially supported in parallel with the intermediate transfer member 55 so as to contact the lower surface of the intermediate transfer member 55. The transfer means is, for example, a transfer roller 57 which is rotated in the clockwise direction shown by an arrow at the same peripheral speed as the intermediate transfer member 55. The transfer roller 57 may be disposed so as to contact the intermediate transfer member 55 directly or with a belt or the like therebetween.

The transfer roller 57 basically comprises a central core metal 57*b* and a conductive elastic layer 57*a* formed on the outer periphery thereof.

The intermediate transfer member 55 and the transfer member, in this case, transfer roller 57, used in the present invention can be made of general materials. In the present invention, the volume specific resistivity of the transfer member is set to be lower than that of the intermediate transfer member so as to decrease the voltage applied to the transfer member, thereby forming a good toner image on the transfer member and preventing the transfer material from winding around the intermediate transfer member 55. Particularly, the volume specific resistivity of the elastic layer of the intermediate transfer member is preferably at least 10 times higher than that of the elastic layer of the transfer member.

The hardness of the intermediate transfer member and the transfer member is measured in accordance with JIS K-6301. The intermediate transfer member used in the present invention preferably comprises an elastic layer having a hardness within the range of 10 to 40 degrees. It is preferable for preventing winding of the recording material around the intermediate transfer member that the hardness of the elastic layer of the transfer member used in the present invention is preferably 41 to 80 degrees and higher than that of the elastic layer of the intermediate transfer member. If the hardness of the elastic layer of the transfer member is lower than that of the elastic layer of the intermediate transfer member, a recess is formed on the side of the transfer member, thereby readily causing the recording material to be wound around the intermediate transfer member.

For example, the transfer roller 57 is rotated at the same peripheral speed as or a different peripheral speed from that of the intermediate transfer member 55. A recording material 56 is conveyed to a portion between the intermediate transfer member 55 and the transfer roller 57. At the same time, a bias having polarity opposite to the frictional charge possessed by the toner is applied to the transfer roller 57 from transfer bias means to transfer the toner image held on the intermediate transfer member onto the surface of the recording material 56. Residual toner on the intermediate transfer member 55, which was not transferred to the recording material 56, is cleaned off by a cleaning member 60 for the intermediate transfer member, and recovered by a cleaning container 62 for the intermediate transfer member. The toner image transferred onto the recording material 56 is fixed to the recording material 56 by a heat fixing unit 61.

The transfer roller may be formed by using the same material as the charging roller 52. The transfer process is preferably performed under conditions in which the contact pressure of the roller is 2.94 to 490 N/m (3 to 500 g/cm), and more preferably 19.6 to 294 N/m, and the DC voltage is 0.2 to 10 kV.

If the linear pressure as the contact pressure is less than 2.94 N/m, deviation occurs in conveyance of the recording material, and transfer error easily occurs.

For example, the conductive elastic layer 57*b* of the transfer roller 57 is a solid or foamed layer prepared by mixing and dispersing a conductive additive such as carbon black, zinc oxide, tin oxide or silicon carbide in an elastic material such as polyurethane rubber or EPDM (ethylene-propylene-diene terpolymer) so that the electric resistance value (volume resistivity) is adjusted to a medium value of $10^6$ to $10^{10}$ Ωcm.

In the present invention, the specified wax is contained in a toner, and the contact angle between the wax and the pressure contact fixing member is set within the specified range so as to obtain a clear full-color projected image having good low-temperature fixing properties and anti-offset properties, and, when applied to OHP, further exhibiting excellent transmission.

When contact angle C at 100° C. between the cleaning member and the wax contained in the toner is set within the range of 0° to 60°, the residual toner which adheres to the surface of the heating member can effectively be removed, thereby improving durability in copying on many sheets.

Although the construction of the present invention is described in detail below with reference to examples, the present invention is not limited to these examples.

EXAMPLES

Example 1

450 g of 0.1M $Na_3PO_4$ aqueous solution was poured into 710 g of ion-exchanged water, and the resultant mixture was then heated to 60° C., followed by agitation at 1300 rpm by using TK type Homomixer (produced by Tokushu Kikakogyo). 68 g of 1.0M $CaCl_2$ aqueous solution was gradually added to the mixture to obtain an aqueous medium containing $Ca_3(PO_4)_2$.

Styrene 166 g

N-butyl acrylate 34 g

Copper phthalocyanine 15 g

Di-t-butylsalicylic acid metallic compound 3 g

Saturated polyester 10 g (acid value 11, peak molecular weight 8500)

Monoester wax 40 g (Mw: 500, Mn: 400, Mw/Mn: 1.25, melting point: 70° C., Vickers hardness: 1.1, SP value: 8.6)

These components were heated to 60°, and uniformly mixed at 12000 rpm by using TK type Homomixer (produced by Tokushu Kikakogyo) to form a dispersion. 10 g of polymerization initiator, 2,2'-azobis(2,4-dimethylvaleronitrile), was dissolved in the resultant dispersion to prepare a polymerizable monomer composition. The polymerizable monomer composition was then poured into the aqueous medium, and the resultant mixture was agitated at 10000 rpm for 20 minutes by the TK type homomixer in an $N_2$ atmosphere to form particles of the polymerizable monomer composition. The aqueous medium was then heated to 80° C. under agitation by a paddle agitating element to effect polymerization reaction for 10 hours.

After the completion of polymerization reaction, the polymerization solution was cooled, and hydrochloric acid was added to dissolved the calcium phosphate, followed by filtration, washing with water and drying to obtain polymer particles (toner particles).

As a result of measurement of sections of the thus-obtained polymer particles by using a transmission electron microscope (TEM), a core-shell structure was confirmed in which the wax is involved in the outer shell resin layer.

The binder resin of the polymer particles had the physical properties of a SP value of 19 and a glass transition temperature Tg of 60° C.

2.0 parts by weight of hydrophobic titanium oxide having a specific surface area of 100 $m^2/g$ measured by the BET method was externally added to 100 parts by weight of polymer particles (toner particles) to obtain cyan toner having an average particle size of 6.2 μm.

93 parts by weight of silicone-coated ferrite carrier of 35 pm was mixed with 7 parts by weight of cyan toner to obtain two-component developing agent No. 1.

This developing agent No. 1 was tested by copying each of two originals respectively having image areas of 20% and 50% on 10,000 sheets using commercial full color copying machine CLC-800 (produced by Canon) as the image forming apparatus shown in FIG. 3, in which each of the heating rollers and pressure rollers of the fixing device were changed to a roller having a surface layer coated with FEP of 10 μm, and the oil applying mechanism was removed, as shown in FIG. 1. Evaluation was made on the basis of the evaluation method below.

In this test, the contact angles between the fixing roller and wax were the following:

$$A=69°,\ B=74°,\ B-A=5°$$

Evaluation method:

(1) OHP transmittance

OHP transmittance was measured by using Shimazu recording spectrophotometer UV2200 (produced by Shimazu Seisakusho) with a toner in an amount per unit area of 1.0 $mg/cm^2$ under the assumption that the transmittance of an OHP film alone is 100%. Measurement wavelengths for magenta, yellow and cyan toners were 650 nm, 500 nm and 600 nm, respectively. Transmittance was evaluated on the basis of the following criteria:

A: 60% or more

B: 55% to less than 60%

C: 50% to less than 55%

D: less than 50%

(2) Nonuniformity in image glossiness

A A4-size solid image was fixed to CLC-SK paper (produced by Canon) with a toner in an amount per unit area of 1.0 $mg/cm^2$, and a difference between maximum and minimum glossiness was measured by using a handy gloss meter, Gloss Checker IG-310 (incident angle 60°, produced by Horiba Seisakusho). Evaluation was made on the basis of the following criteria:

A: 3 or less

B: over 3 to 6

C: over 6 to 10

D: over 10

(3) Anti-offset properties 10,000 sheets were continuously passed, and evaluation was made on the basis of the following criteria:

A: The surface and back of recording paper were not stained until 10,000 sheets were passed.

B: The surface and back of recording paper were slightly stained until 10,000 sheets were passed.

C: The back of recording paper was stained during passage of 5000 to 10,000 sheets.

D: The back of recording paper was stained during passage of up to 5000 sheets.

(4) Uniformity in image quality

An A4-size solid image was fixed to CLC-SK paper with a toner in an amount per unit area of 0.5 $mg/cm^2$, and a difference between maximum and minimum image densities was measured. Uniformity in image quality was evaluated on the basis of the following criteria:

A: 0.05 or less

B: over 0.05 to 0.1

C: over 0.1 to 0.15

D: over 0.15

(5) Storage properties 5 g of toner which was adjusted to a desired particle size, and if required, to which additives were externally added, was added to a 100-cc cap, and then allowed to stand in a dryer at 50° C. for 3 days.

The degree of aggregation of the sample was measured by using a vibrating sieve of a powder tester (Hosokawa Micron Co.) to evaluate storage properties.

In measurement, sieves of 400 mesh, 200 mesh and 100 mesh were stacked on a vibrating base with the 100-mesh sieve at the top in the order of increasing the mesh size, i.e., in the order of 400 mesh, 200 mesh and 100 mesh. The sample was added to the 100-mesh sieve set on the vibrating base which was vibrated for 15 seconds by inputting a voltage of 18 V thereto so that the amplitude of the vibrating base is within 0.5 mm. The weight of the sample remaining on each of the sieves was measured, and the degree of aggregation was obtained on the basis of an equation set forth below.

At this time, the degree of aggregation of toner which was not placed in the dryer at 50° C. was used as a reference value, and the storage properties were judged by the rate of change in the degree of aggregation.

Degree of aggregartion (%) =

$$\frac{\text{weight of the sample on 100-mesh sieve}}{5\text{ g}} \times 100 + \frac{\text{weight of the sample on 200-mesh sieve}}{5\text{ g}} \times 100 \times \frac{3}{5} +$$

-continued $$\frac{\text{weight of the sample on 400-mesh sieve}}{5\,g} \times 100 \times \frac{1}{5}$$

Measurement conditions were 23° C. and 65% RH.

A: less than 20%

B: 20 to less than 25%

C: 25% to less than 30%

D: 30% or more

Comparative Example 1

Developing agent No. 2 was prepared by the same method as Example 1 except that paraffin wax (Mw: 570, Mn: 380, Mw/Mn=1.50, melting point: 69° C., viscosity: 8 mPa.s, Vickers hardness: 0.7, SP value: 8.3) was used in place of the monoester wax used in Example 1, and then evaluated. The contact angles were the following:

$A=83°$, $B=92°$, $B-A=9°$

It is thought that a satisfactory image is not attained due to the large contact angles.

Comparative Example 2

Evaluation was made by the same method as Example 1 except that each of the heating roller and the pressure roller had a surface layer of PTFE in place of FEP used in Example 1. However, satisfactory effects could not be obtained. This is thought to be due to improper contact angles.

Comparative Example 3

Evaluation was made by the same method as Example 1 except that each of the heating roller and the pressure roller had a surface layer of RTV silicone rubber in place of FEP used in Example 1. However, satisfactory effects could not be obtained. This is thought to be due to improper contact angles.

Comparative Example 4

Developing agent No. 3 was prepared by the same method as Example 1 except that paraffin wax (Mw: 580, Mn: 415, Mw/Mn=1.4, melting point: 70° .C, viscosity: 6.8 mPa.s, Vickers hardness: 0.7, SP value: 8.3), which was obtained by molecular weight fractionation of the paraffin wax used in Comparative Example 1, was used in place of the monoester wax used in Example 1, and then evaluated. As a result, satisfactory OHP transmittance could not be obtained, as in Comparative Example 1.

Comparative Example 5

Developing agent No. 4 was prepared by the same method as Example 1 except that acrylic acid-modified wax (Mw: 1800, Mn: 1290, Mw/Mn=1.4, melting point: 98° C., viscosity: 7.1 mPa.s, Vickers hardness: 0.8, SP value: 10.8) was used in place of the monoester wax used in Example 1, and then evaluated. As a result, storage properties and anti-offset properties deteriorated. This is thought to be due to the state wherein the wax is not uniformly involved in the toner because of the large SP value of the wax.

Comparative Example 6

Developing agent No. 5 was prepared by the same method as Example 1 except that fluorine-modified wax (Mw: 600, Mn: 410, Mw/Mn=1.46, melting point: 95° C., viscosity: 8.3 mPa.s, Vickers hardness: 1.4, SP value: 8.0) was used in place of the monoester wax used in Example 1, and then evaluated. As a result, a good image could not be obtained. This is thought to be due the fact that a large value of B−A makes it impossible to attain satisfactory fixing properties.

Comparative Example 7

Developing agent No. 6 was prepared by the same method as Example 1 except that silicone wax (Mw: 1600, Mn: 1000, Mw/Mn=1.6, melting point: 110° C., viscosity: 12 mpa.s, Vickers hardness: 1.5, SP value: 14.2) was used in place of the monoester wax used in Example 1, and then evaluated. As a result, a uniform image could not be obtained.

Comparative Example 8

Developing agent No. 7 was prepared by the same method as Example 1 except that natural carnauba wax (Mw: 900, Mn: 530, Mw/Mn=1.70, melting point: 65° C., viscosity: 6.3 mPa.s, Vickers hardness: 0.8, SP value: 8.7) was used in place of the monoester wax used in Example 1, and then evaluated. As a result, storage properties deteriorated. This is thought to be due to the difficulty in uniformly containing the wax in the toner because of a large ratio of Mw/Mn.

Example 2

When an image was formed by the same method as Example 1 except that the heating roller and the pressure roller had surface layers of PFA in place of the FEP layers used in Example 1, good results were obtained.

Example 3

Developing agent No. 8 was prepared by the same method as Example 1 except that diester wax (Mw: 480, Mn: 410, Mw/Mn=1.17, melting point: 73° C., viscosity: 10.5 mPa.s, Vickers hardness: 1.0, SP value: 9.1) was used in place of the monoester wax used in Example 1. Evaluation of the thus-prepared agent showed good results.

Example 4

Developing agent No. 9 was prepared by the same method as Example 1 except that tetraester wax (Mw: 430, Mn: 320, Mw/Mn=1.34, the molecular weight distribution with a shoulder at molecular weight of 850, melting point: 73° C., viscosity: 11.6 mPa.s, Vickers hardness: 1.2, SP value: 8.5) was used in place of the monoester wax used in Example 1. Evaluation of the thus-prepared agent showed good results.

Example 5

Developing agent No. 10 was prepared by the same method as Example 1 except that diester wax (Mw: 1900, Mn: 1400, Mw/Mn=1.36, melting point: 125° C., viscosity: 11.0 mPa.s, Vickers hardness: 1.6, SP value: 8.6) was used in place of the monoester wax used in Example 1. Evaluation of the thus-prepared agent showed good results except slight deterioration in anti-offset properties of an image at a ratio of 50% due to the low melting point of the wax.

Example 6

Developing agent No. 11 was prepared by the same method as Example 1 except that olefin-modified wax (Mw: 1800, Mn: 1280, Mw/Mn=1.41, melting point: 100° C., viscosity: 12.5 mPa.s, Vickers hardness: 3.2, SP value: 8.4)

was used in place of the monoester wax used in Example 1. Evaluation of the thus-prepared agent showed good results except slight deterioration in OHP transmittance due to the high Vickers hardness.

Example 7

Developing agent No. 12 was prepared by the same method as Example 1 except that monomers contained 160 g of styrene, 30 g of n-butyl acrylate and 20 g of methacrylic acid. Evaluation of the thus-prepared agent showed good results except deterioration in OHP transmittance. This is thought to be due to an increase in the difference between the SP values of the binder resin and the wax, as compared with Example 1.

Table 1 shows the physical properties of developing agent Nos. 1 to 12 prepared in Examples 1 to 7 and Comparative Examples 1 to 8. Table 2 shows the evaluation results of Examples 1 to 7 and Comparative Examples 1 to 8.

TABLE 1

| Developing agent Nos. | Wax Mw | Wax Mn | Wax Mw/Mn | Wax Melting point (°C.) | Wax Melt viscosity mPa · s | Wax Vickers hardness | Wax SP value | Binder resin SP value | Binder resin Tg (°C.) |
|---|---|---|---|---|---|---|---|---|---|
| 1 | 500 | 400 | 1.25 | 70 | 6.5 | 1.1 | 8.6 | 19 | 60 |
| 2 | 570 | 380 | 1.50 | 69 | 6.8 | 0.7 | 8.3 | 19 | 60 |
| 3 | 580 | 415 | 1.40 | 70 | 6.8 | 0.7 | 8.3 | 19 | 60 |
| 4 | 1800 | 1290 | 1.40 | 98 | 7.1 | 1.3 | 10.8 | 19 | 60 |
| 5 | 600 | 410 | 1.46 | 95 | 8.3 | 1.4 | 8.0 | 19 | 60 |
| 6 | 1600 | 1000 | 1.60 | 110 | 12.0 | 1.5 | 14.2 | 19 | 60 |
| 7 | 900 | 530 | 1.70 | 65 | 6.3 | 0.8 | 8.7 | 19 | 60 |
| 8 | 480 | 410 | 1.17 | 73 | 10.5 | 1.0 | 8.5 | 19 | 60 |
| 9 | 430 | 320 | 1.34 | 73 | 11.6 | 1.2 | 8.5 | 19 | 60 |
| 10 | 1900 | 1400 | 1.36 | 125 | 11.0 | 1.6 | 8.6 | 19 | 60 |
| 11 | 1800 | 1280 | 1.41 | 100 | 12.5 | 3.2 | 8.4 | 19 | 60 |
| 12 | 500 | 400 | 1.25 | 70 | 6.5 | 1.1 | 8.6 | 21.6 | 59 |

TABLE 2

| | Developing agent No. | Surface layer material of heating member | Contact angle A | Contact angle B | Contact angle B − A | OHP transmittance | Nonuniformity in image glossiness | Anti-offset properties 20% | Anti-offset properties 50% | Uniformity in image | Storage properties |
|---|---|---|---|---|---|---|---|---|---|---|---|
| Example 1 | No. 1 | FEP | 69 | 74 | 5 | A | A | A | A | A | A |
| Comparative Example 1 | No. 2 | FEP | 83 | 92 | 9 | C | C | A | A | C | A |
| Comparative Example 2 | No. 1 | PTFE | 83 | 84 | 1 | A | C | A | C | B | A |
| Comparative Example 3 | No. 1 | Silicone | 49 | 49 | 0 | No paper was passed. | D | D | D | D | A |
| Comparative Example 4 | No. 3 | FEP | 83 | 92 | 9 | C | C | A | A | B | A |
| Comparative Example 5 | No. 4 | FEP | 63 | 70 | 7 | A | B | B | C | C | C |
| Comparative Example 6 | No. 5 | FEP | 73 | 85 | 12 | C | C | B | C | C | A |
| Comparative Example 7 | No. 6 | FEP | 61 | 62 | 1 | B | C | B | C | C | C |
| Comparative Example 8 | No. 7 | FEP | 63 | 69 | 6 | C | C | B | B | C | D |
| Example 2 | No. 1 | PFA | 61 | 70 | 9 | A | A | A | B | A | A |
| Example 3 | No. 8 | FEP | 62 | 67 | 5 | A | A | A | B | A | B |
| Example 4 | No. 9 | FEP | 60 | 65 | 5 | B | A | A | B | A | B |
| Example 5 | No. 10 | FEP | 70 | 75 | 5 | A | A | A | B | A | A |
| Example 6 | No. 11 | FEP | 71 | 75 | 4 | B | A | A | B | A | A |
| Example 7 | No. 12 | FEP | 69 | 74 | 5 | B | A | A | A | A | A |

Example 8

Evaluation was made in the same manner as Example 1 except that the fixing device of full color copying machine CLC-800 used in Example 1 was modified to the device shown in FIG. 2, and the fixing film comprised a surface layer of FEP. Good results were obtained, as shown in Table 3.

TABLE 3

| | Developing agent No. | Surface layer material of heating member | Contact angle A | Contact angle B | Contact angle B – A | OHP transmittance | Nonuniformity in image glossiness | Anti-offset properties 20% | Anti-offset properties 50% | Uniformity in image | Storage properties |
|---|---|---|---|---|---|---|---|---|---|---|---|
| Example 8 | No. 1 | FEP belt | 69 | 74 | 5 | B | A | A | A | A | B |

Example 9

Magenta, yellow and black toners were prepared by the same method as Example 1 except that a quinacridone pigment, C. I. Pigment Yellow 180 and carbon black were respectively used in place of the copper phthalocyanine pigment used in Example 1, and then mixed with a carrier by the same method as in Example 1 to obtain two-component developing agent Nos. 13, 14 and 15, respectively.

An unfixed full color image was formed by using the two-component developing agents Nos. 1, 13, 14 and 15 respectively having the four colors and the commercial full color copying machine CLC-800 used in Example 1, and then fixed by the same fixing device as that used in Example 1 to obtain a full color fixed image. Evaluation of the thus-obtained image showed excellent reproducibility of a pale color and good results. OHP projection of the full color image produced a clear good projected image.

Example 10

An unfixed full color image was formed by using the same method as Example 9 using the two-component developing agent Nos. 1, 13, 14 and 15 respectively having the four colors except that a full color image forming apparatus comprising the intermediate transfer member shown in FIG. 4 was used in place of the commercial full color copying machine CLC-800 used in Example 9, and then fixed by the same fixing device as that used in Example 9. Evaluation of the full color image showed good results, as in Example 9.

Example 11

Magnetic mono-component developing agent No. 16 was obtained from a magnetic toner in the same manner as Example 1 except that toner particles were prepared by using 200 g of silane coupling agent-treated magnetic iron oxide (average particle size 0.25 μm) in place of the copper phthalocyanine pigment used in Example 1, and that hydrophobic silica was used as an external additive.

An unfixed full color image was formed by the same method as Example 10 except that the black development device 54-4 containing black toner of the full color image forming apparatus shown in FIG. 4 was changed to a development device capable of developing the image by using magnetic mono-component developing agent No. 16, and then fixed by the same method as Example 10 to obtain a full color image. Evaluation of the image showed good results, as in Example 10.

Example 12

The developing agent No. 1 used in Example 1 was tested by copying an original having an image area of 50% on 100,000 sheets using commercial full color copying machine CLC-800 (produced by Canon) as the image forming apparatus shown in FIG. 3, in which the surface of each of the heating roller and the pressure roller of the fixing device was coated with FEP of 10 μm, and the cleaning roller was brought into contact with the surface of the heating roller, as shown in FIG. 5.

In this test, the contact angles between the heating roller and the wax were the following:

$A=69°$, $B=74°$, $B-A=5°$

The cleaning roller 107 shown in FIG. 5 which had an outer diameter of a half the diameter of the fixing roller and which comprised HTV silicone rubber (denoted by symbol Q) having hardness of 30 measured in accordance with JIS A was used. At this time, the contact angle C between the cleaning roller and the wax was 60°.

OHP transmittance, nonuniformity in image gloss and anti-offset properties were evaluated in the same manner as Example 1. Cleaning properties were evaluated by the following evaluation method:

(6) Cleaning properties

Cleaning properties were evaluated by fixing an original image having an image area of 50% at a speed of ¼ of the fixing speed for plain paper, and then passing white plain paper at the normal speed. The Macbeth density of the surface of plain paper was measured after passing plain paper and judged on the basis of the evaluation criteria below. The Macbeth density was measured by measuring reflection density using Macbeth densitometer RD918 model (produced by Macbeth Co.) and a filter, and ten measurements were averaged.

(Evaluation criteria)

A: 0.1 or less

B: over 0.1 to 0.2

C: over 0.2

Comparative Example 9

Evaluation was made by the same method as Example 12 except that the developing agent No. 2 used in Comparative Example 2 was used in place of the developing agent No. 1 used in Example 12. In this evaluation, the contact angles were the following:

$A=83°$, $B=92°$, $B-A=9°$, $C=65°$

It is thought that a satisfactory image could not be attained due to the large contact angles.

Comparative Example 10

Evaluation was made by the same method as Example 12 except that RTFE was used in place of FEP used as a surface layer material for the heating roller and the pressure roller in Example 12. However, satisfactory results were not obtained. This is thought to be due to the improper contact angles.

Comparative Example 11

Evaluation was made by the same method as Example 12 except that RTV silicone rubber was used in place of FEP used as a surface layer material for the heating roller and the pressure roller in Example 12. However, satisfactory results were not obtained. This is thought to be due to the improper contact angles.

Example 13

An image was formed by the same method as Example 12 except that PFA was used in place of FEP used as the surface layer material for the heating roller and the pressure roller in Example 12, and the cleaning roller comprised a RVT silicone rubber having rubber hardness of 40 in accordance with ASCA-C. As a result, a good image was obtained.

Example 14

Evaluation was made by the same method as Example 12 except that the developing agent No. 1 used in Example 12 was replaced by the developing agent No. 8 used in Example 3, and the cleaning roller comprised fluororubber (denoted by symbol FKM). The results obtained were satisfactory.

Example 15

Evaluation was made by the same method as Example 12 except that the developing agent No. 1 used in Example 12 was replaced by the developing agent No. 9 used in Example 4. The results obtained were satisfactory.

Table 4 shows the evaluation results obtained in Examples 12 to 15 and Comparative Examples 9 to 11.

TABLE 4

| | Developing agent Nos. | Surface layer material for heating member | Material of cleaning roller | Contact angle (°) A | B | B − A | C | OHP transmittance | Nonuniformity in image glossiness | Anti-offset properties | Cleaning properties |
|---|---|---|---|---|---|---|---|---|---|---|---|
| Example 12 | No. 1 | FEP | Q HTV silicone rubber | 69 | 74 | 5 | 60 | A | A | A | A |
| Comparative Example 9 | No. 2 | FEP | Q HTV silicone rubber | 83 | 92 | 9 | 65 | C | C | A | C |
| Comparative Example 10 | No. 1 | PTFE | Q HTV silicone rubber | 83 | 84 | 1 | 65 | A | C | C | C |
| Comparative Example 11 | No. 1 | Silicone | Q HTV silicone rubber | 49 | 49 | 0 | 65 | No paper was passed. | D | D | D |
| Example 13 | No. 1 | PFA | Q HTV silicone rubber | 61 | 70 | 9 | 55 | A | A | B | A |
| Example 14 | NO. 8 | FEP | FKM Fluororubber | 62 | 67 | 5 | 60 | A | A | B | A |
| Example 15 | No. 9 | FEP | Q HTV silicone rubber | 58 | 65 | 7 | 60 | B | A | B | A |

Example 16

Evaluation was made by the same method as Example 12 except that full color copying machine CLC-800 used in Example 12 was converted to the machine shown in FIG. 6, the surface layer material of the fixing film was changed to FEP, and the cleaning roller 121 comprised an iron hollow pipe coated with a PFA tube of 50 μm to which an appropriate filler was added so as to adjust contact angle C to 55°, and having an outer diameter of a half the length of the belt. Good results were obtained, as shown in Table 5.

TABLE 5

| | Developing agent No. | Surface layer material for heating member | Material of cleaning roller | Contact angle (°) A | B | B − A | C | OHP transmittance | Nonuniformity in image glossiness | Anti-offset properties | Cleaning properties |
|---|---|---|---|---|---|---|---|---|---|---|---|
| Example 16 | No. 1 | FEP belt | Q HTV silicone rubber | 69 | 74 | 5 | 55 | B | A | A | A |

Example 17

A full color fixed image was obtained by using the commercial full color copying machine CLC-800 used in Example 12, and two-component developing agent Nos. 1, 13, 14 and 15 having four colors as developing agents, as in Example 9. As a result, a good image having excellent color reproducibility of a pale color was obtained. When the full color image was projected by OHP, a very clear and good projected image was obtained.

Example 18

An unfixed full color image was formed by using a full color image forming apparatus comprising the intermediate transfer member shown in FIG. 4 in place of the commercial full color copying machine CLC-800 used in Example 17, and the same two-component developing agent Nos. 1, 13, 14 and 15 having four colors as developing agents as those used in Example 17. The unfixed full color image was fixed by using the same fixing device as that used in Example 17 to obtain a full color image. As a result, a good image was obtained, as in Example 17.

Example 19

An unfixed full color image was formed by the same method as Example 17 except that the black developing device 54-4 containing black toner in the full color image forming apparatus shown in FIG. 4 used in Example 18 was changed to the developing unit used in Example 11, which is capable of developing an image by a magnetic mono-component developing agent 16. The unfixed full color image was then fixed by the same method as Example 18 to obtain a full color image. As a result, a good full color image was obtained, as in Example 18.

The individual components shown in outline or designated by blocks in the drawings are all well known in the image forming and heat fixing arts, and their specific construction and operation are not critical to the operation or best mode for carrying out the invention. While the present invention has been described with respect to what are presently considered to be the preferred embodiments, it is to be understood that the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming method comprising the steps of:

forming an electrostatic latent image on a latent image holding member;

developing the electrostatic latent image by using a color toner to form a toner image;

transferring the toner image onto a recording material; and fixing the toner image to the recording material by a heat fixing device comprising a heating member in contact with the toner image;

wherein the color toner comprises at least a binder resin, a colorant, and wax, the wax having a molecular weight distribution measured by gel permeation chromatography (GPC), which has a ratio of the weight average molecular weight (Mw) to the number average molecular weight (Mn) of 1.45 or less, and a solubility parameter (SP value) of 8.4 to 10.5, wherein at least the surface of the heating member is formed with a copolymer having at least tetrafluoroethylene as a repeating unit in a main chain of the copolymer and a fluoroalkyl group in side chains of the copolymer, and contact angles between the wax and the surface of the heating member at 100° C. and 200° C. satisfy the following relations:

$$60° \leqq A \leqq 80°$$

$$10° \geqq B-A \geqq 3°,$$

wherein A is a contact angle between the wax and the surface of the heating member at 100° C., and B is a contact angle between the wax and the surface of the heating member at 200° C.

2. The image forming method according to claim 1, wherein the contact angles A and B satisfy the following relations:

$$60° \leqq A \leqq 72°$$

$$9° \geqq B-A \geqq 4°$$

3. The image forming method according to claim 1, wherein the wax has a molecular weight distribution measured by GPC, which has a ratio of the weight average molecular weight (Mw) to the number average molecular weight (Mn) of 1.30 or less.

4. The image forming method according to claim 1, wherein the wax has a molecular weight distribution measured by GPC, which has a weight average molecular weight (Mw) of 200 to 2000, and a number average molecular weight (Mn) of 150 to 2000.

5. The image forming method according to claim 1, wherein the wax has a molecular weight distribution measured by GPC, which has a weight average molecular weight (Mw) of 200 to 1500, and a number average molecular weight (Mn) of 200 to 1500.

6. The image forming method according to claim 1, wherein the wax has a solubility parameter (SP value) of 8.5 to 10.0.

7. The image forming method according to claim 1, wherein the wax has a melting point of 30° to 150°.

8. The image forming method according to claim 1, wherein the wax has a melting point of 50° to 120°.

9. The image forming method according to claim 1, wherein the wax has a melt viscosity of 1 to 50 mPas·sec.

10. The image forming method according to claim 1, wherein the wax has a melt viscosity of 3 to 30 mPas·sec.

11. The image forming method according to claim 1, wherein the wax has a Vickers hardness of 0.3 to 5.0.

12. The image forming method according to claim 1, wherein the wax has a Vickers hardness of 0.5 to 3.0.

13. The image forming method according to claim 1, wherein the wax has a degree of crystallinity of 10 to 50%.

14. The image forming method according to claim 1, wherein the wax has a degree of crystallinity of 20 to 35%.

15. The image forming method according to claim 1, wherein the color toner contains the wax in an amount of 1 to 40 parts by weight relative to 100 parts by weight of binder resin.

16. The image forming method according to claim 1, wherein the wax comprises at least one member selected from the group consisting of paraffin wax, modified paraffin wax, polyolefin wax, modified polyolefin wax, higher fatty acids, metal salts of higher fatty acids, amide wax, and ester wax.

17. The image forming method according to claim 1, wherein the wax is ester wax.

18. The image forming method according to claim 1, wherein the binder resin includes a solubility parameter (SP value) of 16 to 24.

19. The image forming method according to claim 1, wherein the binder resin has a solubility parameter (SP value) of 17 to 23.

20. The image forming method according to claim 1, wherein the binder resin has a solubility parameter (SP value) higher than the solubility parameter of the wax, and a difference between the solubility parameters (SP value) of the binder resin and the wax is within the range of 6.0 to 15.0.

21. The image forming method according to claim 1, wherein the binder resin has a solubility parameter (SP value) higher than the solubility parameter of the wax, and a difference between the solubility parameters (SP value) of the binder resin and the wax is within the range of 7.0 to 14.0.

22. The image forming method according to claim 1, wherein the binder resin has a glass transition temperature (Tg) of 40° to 90° C.

23. The image forming method according to claim 1, wherein the binder resin has a glass transition temperature (Tg) of 50° to 85° C.

24. The image forming method according to claim 1, wherein the wax has a melting point higher than the glass transition temperature (Tg) of the binder resin, and a difference between the melting point of the wax and the glass transition temperature of the binder resin is not more than 100° C.

25. The image forming method according to claim 1, wherein the wax has a melting point higher than the glass transition temperature (Tg) of the binder resin, and a difference between the melting point of the wax and the glass transition temperature of the binder resin is not more than 75° C.

26. The image forming method according to claim 1, wherein the wax has a melting point higher than the glass transition temperature (Tg) of the binder resin, and a difference between the melting point of the wax and the glass transition temperature of the binder resin is not more than 50° C.

27. The image forming method according to claim 1, wherein the toner is prepared by melting and kneading a toner material containing at least the binder resin, the colorant, and the wax, and the step of pulverizing the kneaded material.

28. The image forming method according to claim 1, wherein the toner is prepared by directly polymerizing a monomer composition containing at least a polymerizable monomer, the colorant, and the wax.

29. The image forming method according to claim 28, wherein the toner is prepared by directly polymerizing a monomer composition containing at least a polymerizable monomer, the colorant, and the wax in an aqueous medium.

30. The image forming method according to claim 29, wherein the toner is prepared by directly polymerizing a monomer composition containing at least a polymerizable monomer, the colorant, and the wax by a suspension polymerization method.

31. The image forming method according to claim 1, wherein the heat fixing device employs a roller heating system comprising a heating roller and a pressure roller, the heating roller being used as the heating member.

32. The image forming method according to claim 1, wherein the heat fixing device employs a film heat fixing system in which the toner image is heat-fixed under pressure contact with a fixing film used as the heating member.

33. The image forming method according to claim 1, wherein the fluoroalkyl group includes a trifluoromethyl group.

34. The image forming method according to claim 1, further comprising the steps of transferring the toner image formed on the latent image holding member onto an intermediate transfer member, and transferring the toner image transferred onto the intermediate transfer member onto the recording material.

35. The image forming method according to claim 1, wherein the electrostatic latent image is developed by using a mono-component type developer containing the color toner.

36. The image forming method according to claim 1, wherein the electrostatic latent image is developed by using a two-component type developer containing the color toner and a carrier.

37. The image forming method according to claim 1, further comprising the step of cleaning the surface of the heating member by bringing the cleaning member into contact with the surface of the heating member of the heat fixing device, wherein the contact angle C, between the wax and the surface of the cleaning member at 100° C. satisfies the following relation $$0° \leqq C \geqq 60°.$$

38. The image forming method according to claim 1, further comprising the step of cleaning a surface of the heating member by bringing a cleaning member into contact with a surface of the heating member of the heat fixing device, wherein the wax has a weight average molecular weight (Mw) of 200 to 2000, and a number average molecular weight (Mn) of 150 to 2000, and the contact angle C, between the wax and the surface of cleaning member at 100° satisfies the following relation:

$$0° \leqq C \leqq 60°.$$

39. The image forming method according to claim 38, wherein at least the surface of the cleaning member comprises at least one of silicone rubber and fluororubber.

40. The image forming method according to claim 38, wherein at least the surface of the cleaning member comprises a fluororesin.

41. The method according to claim 1, wherein the wax has a melting point of 65° to 125°.

42. A heat fixing method comprising the steps of:

bearing a toner image formed by using a color toner on a recording material; and fixing the toner image to the recording material by a heat fixing device comprising a heating member in contact with the toner image;

wherein the color toner comprises at least a binder resin, a colorant, and wax, the wax having a molecular weight distribution measured by gel permeation chromatography (GPC), which has a ratio of the weight average molecular weight (Mw) to the number average molecular weight (Mn) of 1.45 or less, and a solubility parameter (SP value) of 8.4 to 10.5, at least the surface of the heating member is formed with a copolymer having at least tetrafluoroethylene as a repeating unit in a main chain of the copolymer, and a fluoroalkyl group in side chains of the copolymer, and contact angles between the wax and the surface of the heating member at 100° C. and 200° C. satisfy the following relations:

$$60° \leqq A \leqq 80°$$

$$10° \geqq B-A \geqq 3°,$$

wherein A is a contact angle between the wax and the surface of the heating member at 100° C. and B is a contact angle between the wax and the surface of the heating member at 200° C.

43. The heat fixing method according to claim 42, wherein the contact angles A and B satisfy the following relations:

$$60° \leqq A \leqq 72°$$

$$90° \geqq B-A \geqq 4°$$

44. The heat fixing method according to claim 42, wherein the wax has a molecular weight distribution measured by GPC, which has a ratio of the weight average molecular weight (Mw)to the number average molecular weight (Mn) of 1.30 or less.

45. The heat fixing method according to claim 42, wherein the wax has a molecular weight distribution measured by GPC, which has a weight average molecular weight (Mw) of 200 to 2000, and a number average molecular weight (Mn) of 150 to 2000.

46. The heat fixing method according to claim 42, wherein the wax has a molecular weight distribution measured by GPC, which has a weight average molecular weight (Mw) of 200 to 1500, and a number average molecular weight (Mn) of 200 to 1500.

47. The heat fixing method according to claim 42, wherein the wax has a solubility parameter (SP value) of 8.5 to 10.0.

48. The heat fixing method according to claim 42, wherein the wax has a melting point of 30° to 150°.

49. The heat fixing method according to claim 42, wherein the wax has a melting point of 50° to 120°.

50. The heat fixing method according to claim 42, wherein the wax has a melt viscosity of 1 to 50 mPas·sec.

51. The heat fixing method according to claim 42, wherein the wax has a melt viscosity of 3 to 30 mpas·sec.

52. The heat fixing method according to claim 42, wherein the wax has a Vickers hardness of 0.3 to 5.0.

53. The heat fixing method according to claim 42, wherein the wax has a Vickers hardness of 0.5 to 3.0.

54. The heat fixing method according to claim 42, wherein the wax has a degree of crystallinity of 10 to 50%.

55. The heat fixing method according to claim 42, wherein the wax has a degree of crystallinity of 20 to 35%.

56. The heat fixing method according to claim 42, wherein the color toner contains the wax in an amount of 1 to 40 parts by weight relative to 100 parts by weight of binder resin.

57. The heat fixing method according to claim 42, wherein the wax comprises at least one member selected from the group consisting of paraffin wax, modified paraffin wax, polyolefin wax, modified polyolefin wax, higher fatty acids, metal salts of higher fatty acids, amide wax, and ester wax.

58. The heat fixing method according to claim 42, wherein the wax includes ester wax.

59. The heat fixing method according to claim 42, wherein the binder resin has a solubility parameter (SP value) of 16 to 24.

60. The heat fixing method according to claim 42, wherein the binder resin has a solubility parameter (SP value) of 17 to 23.

61. The heat fixing method according to claim 42, wherein the binder resin has a solubility parameter (SP value) higher than the solubility parameter of the wax, and a difference between the solubility parameters (SP value) of the binder resin and the wax is within the range of 6.0 to 15.0.

62. The heat fixing method according to claim 42, wherein the binder resin has a solubility parameter (SP value) higher than the solubility parameter of the wax, and a difference between the solubility parameters (SP value) of the binder resin and the wax is within the range of 7.0 to 14.0.

63. The heat fixing method according to claim 42, wherein the binder resin has a glass transition temperature (Tg) of 40° to 90° C.

64. The heat fixing method according to claim 42, wherein the binder resin has a glass transition temperature (Tg) of 50° to 85° C.

65. The heat fixing method according to claim 42, wherein the wax has a melting point higher than the glass transition temperature (Tg) of the binder resin, and a difference between the melting point of the wax and the glass transition temperature of the binder resin is not more than 100° C.

66. The heat fixing method according to claim 42, wherein the wax has a melting point higher than the glass transition temperature (Tg) of the binder resin, and a difference between the melting point of the wax and the glass transition temperature of the binder resin is not more than 75° C.

67. The heat fixing method according to claim 42, wherein the wax has a melting point higher than the glass transition temperature (Tg) of the binder resin, and a difference between the melting point of the wax and the glass transition temperature of the binder resin is not more than 50° C.

68. The heat fixing method according to claim 42, wherein the toner is prepared by melting and kneading a toner material containing at least the binder resin, the colorant, and the wax, and the step of pulverizing the kneaded material.

69. The heat fixing method according to claim 42, wherein the toner is prepared by directly polymerizing a monomer composition containing at least a polymerizable monomer, the colorant, and the wax.

70. The heat fixing method according to claim 69, wherein the toner is prepared by directly polymerizing a monomer composition containing at least a polymerizable monomer, the colorant, and the wax in an aqueous medium.

71. The heat fixing method according to claim 70, wherein the toner is prepared by directly polymerizing a monomer composition containing at least a polymerizable monomer, the colorant, and the wax by a suspension polymerization method.

72. The heat fixing method according to claim 42, wherein the heat fixing device employs a roller heating system comprising a heating roller and a pressure roller, the heating roller being used as the heating member.

73. The heat fixing method according to claim 42, wherein the heat fixing device employs a film heat fixing system in which the toner image is heat-fixed under pressure contact with a fixing film used as the heating member.

74. The heat fixing method according to claim 42, wherein the fluoroalkyl group includes a trifluoromethyl group.

75. The heat fixing method according to claim 42, further comprising the step of cleaning a surface of the heating member by bringing a cleaning member in contact with a surface of the heating member of the heat fixing device, wherein the contact angle C, between the wax and the surface of the cleaning member at 100° C. satisfies the following relation:

$$0° \leqq C \leqq 60°.$$

76. The heat fixing method according to claim 42, further comprising the step of cleaning a surface of the heating member by bringing a cleaning member into contact with a surface of the heating member of the heat fixing device, wherein the wax has a weight average molecular weight (mw) of 200 to 2000, and a number average molecular weight (Mn) of 150 to 2000, and the contact angle C, between the wax and the surface of the cleaning member at 100° C. satisfies the following relation:

$$0° \leqq C \leqq 60°.$$

77. The image forming method according to claim 76, wherein at least the surface of the cleaning member comprises at least one of silicone rubber and fluororubber.

78. The image forming method according to claim 76, wherein at least the surface of the cleaning member comprises a fluororesin.

79. The method according to claim 42, wherein the wax has a melting point of 65° to 125°.

80. An image forming method comprising the steps of:

forming an electrostatic latent image on a latent image holding member;

developing the electrostatic latent image by using a color toner to form a toner image;

transferring the tone image onto a recording material; and fixing the toner image to the recording material by a heat fixing device comprising a fixing film for contacting the toner image on the recording material, a heating member for heating the fixing film, and a pressing member for imparting a pressure to the recording material;

wherein the color toner comprises at least a binder resin, a colorant, and wax, the wax having a molecular weight distribution measured by gel permeation chromatography (GPC), which has a ratio of the weight average molecular weight (Mw) to the number average molecular weight (Mn) of 1.45 or less, a solubility parameter (SP value) of 8.4 to 10.5, and melting point of 50° to 120° C., wherein at least the surface of the fixing film is formed with a copolymer having at least tetrafluoroethylene as a repeating unit in a main chain of the copolymer, and contact angles between the wax and the surface of the fixing film at 100° C. and 200° C. satisfy the following relations:

$$60 \leqq A \leqq 80°$$

$$10° \geqq B-A \geqq 3°,$$

wherein A is a contact angle between the wax and the surface of the fixing film at 100° C., and B is a contact angle between the wax and the surface of the fixing film at 200° C.

81. The method according to claim 80, wherein the contact angles A and B satisfy the following relations:

$$60° \leqq A \leqq 72°$$

$$9° \geqq B-A \geqq 4°.$$

82. The method according to claim 80, wherein the wax has a molecular weight distribution measured by GPC, which has a ratio of the weight average molecular weight (Mw) to the number average molecular weight (Mn) of 1.30 or less.

83. The method according to claim 80, wherein the wax has a molecular weight distribution measured by GPC, which has a weight average molecular weight (Mw) of 200 to 2000, and a number average molecular weight (Mn) of 150 to 2000.

84. The method according to claim 80, wherein the wax has a solubility parameter (SP value) of 8.4 to 10.5.

85. The method according to claim 80, wherein the wax has a melt viscosity of 1 to 50 mPas·sec.

86. The method according to claim 80, wherein the wax has a Vickers hardness of 0.3 to 5.0.

87. The method according to claim 80, wherein the wax has a degree of crystallinity of 10 to 50%.

88. The method according to claim 80, wherein the color toner contains the wax in an amount of 1 to 40 parts by weight relative to 100 parts by weight of binder resin.

89. The method according to claim 80, wherein the wax comprises at least one member selected from the group consisting of paraffin wax, modified paraffin wax, polyolefin wax, modified polyolefin wax, higher fatty acids, metal salts of higher fatty acids, amide wax, and ester wax.

90. The method according to claim 80, wherein the wax is ester wax.

91. The method according to claim 80, wherein the binder resin includes a solubility parameter (SP value) of 16 to 24.

92. The method according to claim 80, wherein the binder resin has a solubility parameter (SP value) higher than the solubility parameter of the wax, and a difference between the solubility parameters (SP value) of the binder resin and the wax is within the range of 6.0 to 15.0.

93. The method according to claim 80, wherein the binder resin has a glass transition temperature (Tg) of 40° to 90° C.

94. The method according to claim 80, wherein the wax has a melting point higher than the glass transition temperature (Tg) of the binder resin, and a difference between the melting point of the wax and the glass transition temperature of the binder resin is not more than 100° C.

95. The method according to claim 80, wherein the wax has a melting point higher than the glass transition temperature (Tg) of the binder resin, and a difference between the melting point of the wax and the glass transition temperature of the binder resin is not more than 75° C.

96. The method according to claim 80, wherein the wax has melting point higher than the glass transition temperature (Tg) of the binder resin, and a difference between the melting point of the wax and the glass transition temperature of the binder resin is not more than 50° C.

97. The method according to claim 80, wherein the toner is prepared by melting and kneading a toner material containing at least the binder resin, the colorant, and the wax, and the method further comprises the step of pulverizing the kneaded material.

98. The method according to claim 80, wherein the toner is prepared by directly polymerizing a monomer composition containing at least a polymerizable monomer, the colorant, and the wax.

99. The method according to claim 98, wherein the toner is prepared by directly polymerizing a monomer composition containing at least a polymerizable monomer, the colorant, and the wax in an aqueous medium.

100. The method according to claim 99, wherein the toner is prepared by directly polymerizing a monomer composition containing at least a polymerizable monomer, the colorant, and the wax by a suspension polymerization method.

101. The method according to claim 80, wherein at least the surface of the fixing film is formed with a copolymer having at least tetrafluoroethylene as a repeating unit in a main chain of the copolymer, and at least one of a fluoroalkoxy group, a fluoroalkyl group, and the fluoroalkoxy and the fluoroalkyl groups in side chains of the copolymer.

102. The method according to claim 101 wherein the fluoroalkyl group includes a trifluoromethyl group.

103. The method according to claim 80, wherein at least the surface of the fixing film is formed with a copolymer having at least tetrafluoroethylene as a repeating unit in a main chain of the copolymer, and a fluoroalkyl group in side chains of the copolymer.

104. The method according to claim 103, wherein the fluoroalkyl group includes a trifluoromethyl group.

105. The method according to claim 80, further comprising the steps of transferring the toner image formed on the latent image holding member onto an intermediate transfer member, and transferring the toner image transferred onto the intermediate transfer member onto the recording material.

106. The method according o claim 1, wherein the electrostatic latent image is developed by using a monocomponent type developer containing the color toner.

107. The method according to claim 80, wherein the electrostatic latent image is developed by using a two-component type developer containing the color toner and a carrier.

108. The method according to claim 80, further comprising the step of cleaning the surface of the fixing film by bringing the cleaning member into contact with the surface of the fixing film of the film heat fixing device, wherein the contact angle C between the wax and the surface of the cleaning member at 100° C. satisfies the following relation:

$$0° \leqq C \leqq 60°.$$

109. The method according to claim 80, further comprising the step of cleaning a surface of the fixing film by bringing a cleaning member into contact with a surface of the fixing film of the film heating fixing device, wherein the wax has a weight average molecular weight (Mw) of 200 to 2000, and a number average molecular weight (Mn) of 150 to 2000, and the contact angle C between the wax and the surface of the cleaning member at 100° C. satisfies the following relation:

$$0° \leqq C \leqq 60°.$$

110. The method according to claim 109, wherein at least the surface of the cleaning member comprises at least one of silicone rubber and fluororubber.

111. The method according to claim 109, wherein at least the surface of the cleaning member comprises a fluororesin.

112. A heat fixing method comprising the steps of:

bearing a toner image formed by using color toner on a recording material; and fixing the toner image to the recording material by a heat fixing device comprising a fixing film for contacting the toner image on the recording material, a heating member for heating the fixing film, and a pressing member for imparting a pressure to the recording material;

wherein the color toner comprises at least a binder resin, a colorant, and wax, the wax having a molecular weight distribution measured by gel permeation chromatography (GPC), which has a ratio of the weight average molecular weight (Mw) to the number average molecular weight (Mn) of 1.45 or less, a solubility parameter (SP value) of 8.4 to 10.5, and a melting point of 50° to 120° C., wherein at least the surface of the fixing film is formed with a copolymer having at least tetrafluoroethylene as a repeating unit in a main chain of the copolymer, and contact angles between the wax and the surface of the fixing film at 100° C. and 200° C. satisfy the following relations:

$$60° \leqq A \leqq 80°$$

$$10° \geqq B-A \geqq 3°,$$

wherein A is contact angle between the wax and the surface of the fixing film at 100° C., and B is a contact angle between the wax and the surface of the fixing film at 200° C.

113. The method according to claim 112, wherein the contact angles A and B satisfy the following relations:

$$60° \leqq A \leqq 72°$$

$$9° \geqq b-A \geqq 4°.$$

114. The method according to claim 112, wherein the wax has molecular weight distribution measured by GPC, which has a ratio of the weight average molecular weight (Mw) to the number average molecular weight (Mn) of 1.30 or less.

115. The method according to claim 112, wherein the wax has a molecular weight distribution measured by GPC, which has a weight average molecular weight (Mw) of 200 to 2000, and a number average molecular weight (Mn) of 150 to 2000.

116. The method according to claim 112, wherein the wax has a solubility parameter (SP value) of 8.4 to 10.5.

117. The method according to claim 112, wherein the wax has a melt viscosity of 1 to 50 mPas·sec.

118. The method according to claim 112, wherein the wax has a Vickers hardness of 0.3 to 5.0.

119. The method according to claim 112, wherein the wax has a degree of crystallinity of 10 to 50%.

120. The method according to claim 112, wherein the color toner contains the wax in an amount of 1 to 40 parts by weight relative to 100 parts by weight of binder resin.

121. The method according to claim 112, wherein the wax comprises at least one member selected from the group consisting of paraffin wax, modified paraffin wax, polyolefin wax, modified polyolefin wax, higher fatty acids, metal salts of higher fatty acids, amide wax, and ester wax.

122. The method according to claim 112, wherein the wax includes ester wax.

123. The method according to claim 112, wherein the binder resin has a solubility parameter (SP value) of 16 to 24.

124. The method according to claim 112, wherein the binder resin has a solubility parameter (SP value) higher than the solubility parameter of the wax and a difference between the solubility parameters (SP value) of the binder resin and the wax is within the range of 6.0 to 15.0.

125. The method according to claim 112, wherein the binder resin has a glass transition temperature (Tg) of 40° to 90° C.

126. The method according to claim 112, wherein the wax has a melting point higher than the glass transition temperature (Tg) of the binder resin, and a difference between the melting point of the wax and the glass transition temperature of the binder resin is not more than 100° C.

127. The method according to claim 112, wherein the wax has a melting point higher than the glass transition temperature (Tg) of the binder resin, and a difference between the melting point of the wax and the glass transition temperature of the binder resin is not more than 75° C.

128. The method according to claim 112, wherein the wax has a melting point higher than the glass transition temperature (Tg) of the binder resin, and a difference between the melting point of the wax and the glass transition temperature of the binder resin is not more than 50° C.

129. The method according to claim 112, wherein the toner is prepared by melting and kneading a toner material containing at least the binder resin, the colorant, and the wax, and the method further comprises the step of pulverizing the kneaded material.

130. The method according to claim 112, wherein the toner is prepared by directly polymerizing a monomer composition containing at least a polymerizable monomer, the colorant, and the wax.

131. The method according to claim 130, wherein the toner is prepared by directly polymerizing a monomer composition containing at least a polymerizable monomer, the colorant, and the wax in an aqueous medium.

132. The method according to claim 131, wherein the toner is prepared by directly polymerizing a monomer composition containing at least a polymerizable monomer, the colorant, and the wax by a suspension polymerization method.

133. The method according to claim 112, wherein at least the surface of the fixing film is formed with a copolymer having at least tetrafluoroethylene as a repeating unit in a main chain of the copolymer, and at least one of a fluoroalkoxy group, a fluoroalkyl group, and the fluoroalkoxy and fluoroalkyl groups in side chains of the copolymer.

134. The method according to claim 112, wherein the fluoroalkyl group includes a trifluoromethyl group.

135. The method according to claim 112, wherein at least the surface of the fixing film is formed with a copolymer having at least tetrafluoroethylene as a repeating unit in a main chain of the copolymer, and a fluoroalkyl group in side chains of the copolymer.

136. The method according to claim 135, wherein the fluoroalkyl group includes a trifluoromethyl group.

137. The method according to claim 112, further comprising the step of cleaning a surface of the fixing film by bringing a cleaning member in contact with a surface of the fixing film of the film heat fixing device, wherein the contact angle C between the wax and the surface of the cleaning member at 100° C. satisfies the following relation:

$$0° \leqq C \leqq 60°.$$

138. The method according to claim 112, further comprising the step of cleaning a surface of the fixing film by bringing a cleaning member into contact with a surface of the fixing film of the film heat fixing device, wherein the wax has a weight average molecular weight (Mw) of 200 to 2000, and a number average molecular weight (Mn) of 150 to 2000, and the contact angle C between the wax and the surface of the cleaning member at 100° C. satisfies the following relation:

$$0° \leqq C \leqq 60°.$$

139. The image forming method according to claim 138, wherein at least the surface of the cleaning member comprises at least one of silicone rubber and fluororubber.

140. The image forming method according to claim 138, wherein at least the surface of the cleaning member comprises a fluororesin.

* * * * *

UNITED STATES PATENT AND TRADEMARK OFFICE

CERTIFICATE OF CORRECTION

PATENT NO. : 5,747,213

DATED : May 5, 1998

INVENTOR(S) : Kenji OKADO, et al.

It is certified that error appears in the above-identified patent and that said Letters Patent is hereby corrected as shown below:

COLUMN 3:

Line 55, " $R-\overset{\overset{\displaystyle O}{\|}}{C}-O-(CH_2-CH_2)_a-O-\overset{\overset{\displaystyle O}{\|}}{C}-R$" should read -- $R-\overset{\overset{\displaystyle O}{\|}}{C}-O-(CH_2-CH_2)_n-O-\overset{\overset{\displaystyle O}{\|}}{C}-R$--.

COLUMN 6:

Line 30, "$10° \geq B-A \geq 30°$" should read --$10° \geq B-A \geq 3°$--.

COLUMN 8:

Line 52, "a" should be deleted.

UNITED STATES PATENT AND TRADEMARK OFFICE

CERTIFICATE OF CORRECTION

PATENT NO. : 5,747,213

DATED : May 5, 1998

INVENTOR(S) : Kenji OKADO, et al.

It is certified that error appears in the above-identified patent and that said Letters Patent is hereby corrected as shown below:

COLUMN 12:

Line 38, "lake" should read --like--.
Line 40, "lake" should read --like-- and "(lake" should read --(like--.

COLUMN 14:

Line 51, "of" (first occurrence) should read --Of--.

COLUMN 17:

Line 61, "and" should be deleted.

COLUMN 19:

Line 19, "lake" should read --like--.
Line 21, "or" should read --or in--.

COLUMN 20:

Line 9, "tone" should read --toner--.

UNITED STATES PATENT AND TRADEMARK OFFICE

CERTIFICATE OF CORRECTION

PATENT NO. : 5,747,213

DATED : May 5, 1998

INVENTOR(S) : Kenji OKADO, et al.

It is certified that error appears in the above-identified patent and that said Letters Patent is hereby corrected as shown below:

COLUMN 45:

Line 47, "tone" should read --toner--.

COLUMN 48:

Line 28, "is" should read --is a--.

COLUMN 50:

Line 5, "claim 112," should read --claim 133,--.

Signed and Sealed this

Twenty-second Day of December, 1998

*Attest:*

Bruce Lehman

BRUCE LEHMAN

*Attesting Officer*

*Commissioner of Patents and Trademarks*